US011270710B2

(12) United States Patent
Nagisetty et al.

(10) Patent No.: US 11,270,710 B2
(45) **Date of Patent: *Mar. 8, 2022**

(54) ENCODER AND ENCODING METHOD

(71) Applicant: Panasonic Intellectual Property Corporation of America, Torrance, CA (US)

(72) Inventors: Srikanth Nagisetty, Singapore (SG); Hiroyuki Ehara, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/640,708

(22) PCT Filed: Aug. 31, 2018

(86) PCT No.: PCT/JP2018/032309

§ 371 (c)(1),
(2) Date: Feb. 20, 2020

(87) PCT Pub. No.: WO2019/058927

PCT Pub. Date: Mar. 28, 2019

(65) Prior Publication Data

US 2020/0357417 A1 Nov. 12, 2020

(30) Foreign Application Priority Data

Sep. 25, 2017 (JP) ..... JP2017-183360

(51) Int. Cl.
*G10L 19/008* (2013.01)
*G10L 19/22* (2013.01)

(52) U.S. Cl.
CPC ..... *G10L 19/008* (2013.01); *G10L 19/22* (2013.01)

(58) Field of Classification Search
CPC ... G10L 19/22; G10L 19/008; G10L 19/0017; G10L 19/0018; G10L 19/005;
(Continued)

(56) References Cited

U.S. PATENT DOCUMENTS

2004/0230423 A1* 11/2004 Chrysafis ..... G10L 19/008 704/216
2009/0092258 A1* 4/2009 Merimaa ..... H04S 7/30 381/1
2018/0358024 A1* 12/2018 Pobloth ..... G10L 19/22

FOREIGN PATENT DOCUMENTS

EP WO 2016184958 A * 11/2016 ..... G10L 19/008
JP 2006267943 A * 10/2006 ..... G10L 19/00
WO 2016/184958 11/2016

OTHER PUBLICATIONS

International Search Report of PCT application No. PCT/JP2018/032309 dated Oct. 9, 2018.
Christof Faller, "Multiple-Loudspeaker Playback of Stereo Signals", Journal of the Audio Engineering Society vol. 54, No. 11, Nov. 11, 2006, pp. 1051-1064 and 431.
Yue Lang et al., "Novel low complexity coherence estimation and synthesis algorithms for parametric stereo coding", 20th European Signal Processing Conference (EUSIPCO 2012), Aug. 2012, pp. 2427-2431.
(Continued)

*Primary Examiner* — Leshui Zhang
(74) *Attorney, Agent, or Firm* — Greenblum & Bernstein, P.L.C.

(57) ABSTRACT

In an encoder, a signal analysis unit performs signal analysis on an L channel signal and an R channel signal that constitute a stereo signal and generates a parameter used to determine a coding mode for each of an L channel and an R channel. A DMA stereo encoding unit encodes the L channel signal and the R channel signal by using a coding mode common to the L channel signal and the R channel signal. At this time, the DMA stereo encoding unit determines the common coding mode by selecting, out of the L channel and the R channel, the one that has a lower ratio of energy of an environmental sound component to the entire energy of the channel and using the parameter of the selected channel.

10 Claims, 15 Drawing Sheets

(58) Field of Classification Search
CPC ... G10L 19/012; G10L 19/02; G10L 19/0204; G10L 19/0208; G10L 19/0212; G10L 19/0216; G10L 19/022; G10L 19/025; G10L 19/028; G10L 19/03; G10L 19/032; G10L 19/035; G10L 19/038; G10L 19/04; G10L 19/06; G10L 19/07; G10L 19/08; G10L 19/09; G10L 19/087; G10L 19/093; G10L 19/097; G10L 19/10; G10L 19/107; G10L 19/113; G10L 19/12; G10L 19/125; G10L 19/13; G10L 19/135; G10L 19/16; G10L 19/167; G10L 19/173; G10L 19/18; G10L 19/20; G10L 19/24; G10L 19/26; G10L 19/265; H04R 5/00; H04R 9/16; H04R 11/12; H04R 17/08
USPC ..... 700/500–504; 381/19–23
See application file for complete search history.

(56) References Cited

OTHER PUBLICATIONS

Juha Merimaa et al., "Correlation-Based Ambience Extraction from Stereo Recodings", Audio Engineering Society 123rd Convention, Oct. 2007.
3GPP TS 26.445 V14.0.0, "3rd Generation Partnership Project; Technical Specification Group Services and System Aspects; Codec for Enhanced Voice services (EVS); Detailed Algorithmic Description (Release 14)", Mar. 2017.
J. D. Johnston et al., "Sum-Difference Stereo Transform Coding", proc. IEEE ICASSP1992, pp. II-569-II-572, Apr. 1992.
Erik Schuijers et al., "Advances in Parametric Coding for High-Quality Audio", Audio Engineering Society 114th Convention, Mar. 2003.

* cited by examiner

FIG. 2

| Bitrate (kbps) | 13.2 | 16.4 | 24.4 | 32 | 48 | 64 |
|---|---|---|---|---|---|---|
| SWB | | | | | | |
| Speech | ACELP | ACELP | ACELP | ACELP | TCX | ACELP |
| Audio | GSC/TCX/ HQ MDCT | TCX/ HQ MDCT | TCX/ HQ MDCT | TCX/ HQ MDCT | TCX | HQ MDCT |
| FB | | | | | | |
| Speech | | ACELP | ACELP | ACELP | TCX | ACELP |
| Audio | | TCX | TCX/ HQ MDCT | TCX/ HQ MDCT | TCX | HQ MDCT |

FIG. 12

| Coding Mode | Channel Correlation ($\alpha$) | range |
|---|---|---|
| Mid-Side Coding | High | [ 0.6 1 ] |
| Dual Mono with mode alignment (DMA) | Weak | [ 0 0.6 ] |
| Dual Mono (DM) | Zero | 0 |

ENCODER AND ENCODING METHOD

TECHNICAL FIELD

The present disclosure relates to an encoder and an encoding method.

BACKGROUND ART

In recent years, EVS (Enhanced Voice Services) codec has been standardized in 3GPP (3rd Generation Partnership Project) (refer to, for example, NPL 1). The EVS codec is designed for encoding monophonic audio signals.

CITATION LIST

Non Patent Literature

NPL 1: 3GPP TS 26.445 V14.0.0, "Codec for Enhanced Voice services (EVS); Detailed algorithmic description (Release 14)", 2017 March NPL 2: J. D. Johnston, A. J. Ferreira, "SUM-DIFFERENCE STEREO TRANSFORM CODING," proc. IEEE ICASSP1992, pp. 11-560-11-572, 1992

NPL 3: E. Schuijers, W. Oomen, B. Brinker, and J. Breebaart, "Advances in Parametric Coding for High-Quality Audio", in Preprint 5852, 114th AES convention, Amsterdam, March 2003.

NPL 4: C. Faller, "Multiple-loudspeaker playback of stereo signals", Journal of the Audio Engineering Society volume 54, issue 11, pp. 1051-1064, November 2006.

NPL 5: Yue Lang et al. "Novel low complexity coherence estimation and systhesis algorithms for parametric stereo coding", EUSIPCO, August 2012, pp. 2427-2431.

NPL 6: J. Merimaa et al., "Correlation based ambience extraction from stereo recodings", in Preprint 7282, 123rd AES convention, October 2007.

SUMMARY OF INVENTION

The EVS codec does not support input and output of a stereo signal. However, if each of channels (the left channel (L channel) and the right channel (R channel)) of a stereo signal is processed by using the EVS codec (monaural encoding), the EVS codec can be used in a stereo rendering system. However, if a stereo signal is encoded by using a multi-mode monaural codec that performs encoding by switching among a plurality of coding modes like the EVS codec (the monaural encoding performed separately for the L channel signal and the R channel signal of the stereo signal is also referred to as "dual mono encoding"), different coding modes may be used for the L channel and the R channel of the stereo signal. Consequently, the sound quality in stereo reproduction may deteriorate.

One aspect of the present disclosure provides an encoder and an encoding method capable of preventing a decrease in sound quality in stereo reproduction even when a stereo signal is encoded by using a multi-mode codec.

According to an aspect of the present disclosure, an encoder includes a signal analysis circuit that performs signal analysis on a left channel signal and a right channel signal that constitute a stereo signal and generates a parameter used to determine a coding mode for each of a left channel and a right channel and an encoding circuit that encodes the left channel signal and the right channel signal by using a coding mode common to the left channel signal and the right channel signal. The encoding circuit determines the common coding mode by selecting, out of the left channel and the right channel, the one that has a lower ratio of energy of an environmental sound component to the entire energy of the channel and using the parameter of the selected channel.

It should be noted that general or specific embodiments may be implemented as a system, a method, an integrated circuit, a computer program, a storage medium, or any selective combination thereof.

According to one aspect of the present disclosure, even when a stereo signal is encoded by using a multi-mode codec, deterioration in sound quality can be prevented in stereo reproduction.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF DRAWINGS

FIG. 2 is a diagram illustrating an example of a correspondence relationship between a signal analysis parameter and a coding mode.

FIG. 12 is a diagram illustrating an example of a correspondence relationship between the range of an inter-channel correlation value and a coding mode according to the third embodiment.

DESCRIPTION OF EMBODIMENTS

Embodiments of the present disclosure are described in detail below with reference to the accompanying drawings.

A 3GPP EVS encoding system is briefly described first as an example of a multi-mode monaural encoding system (refer to, for example, NPL 1).

Figure 1:
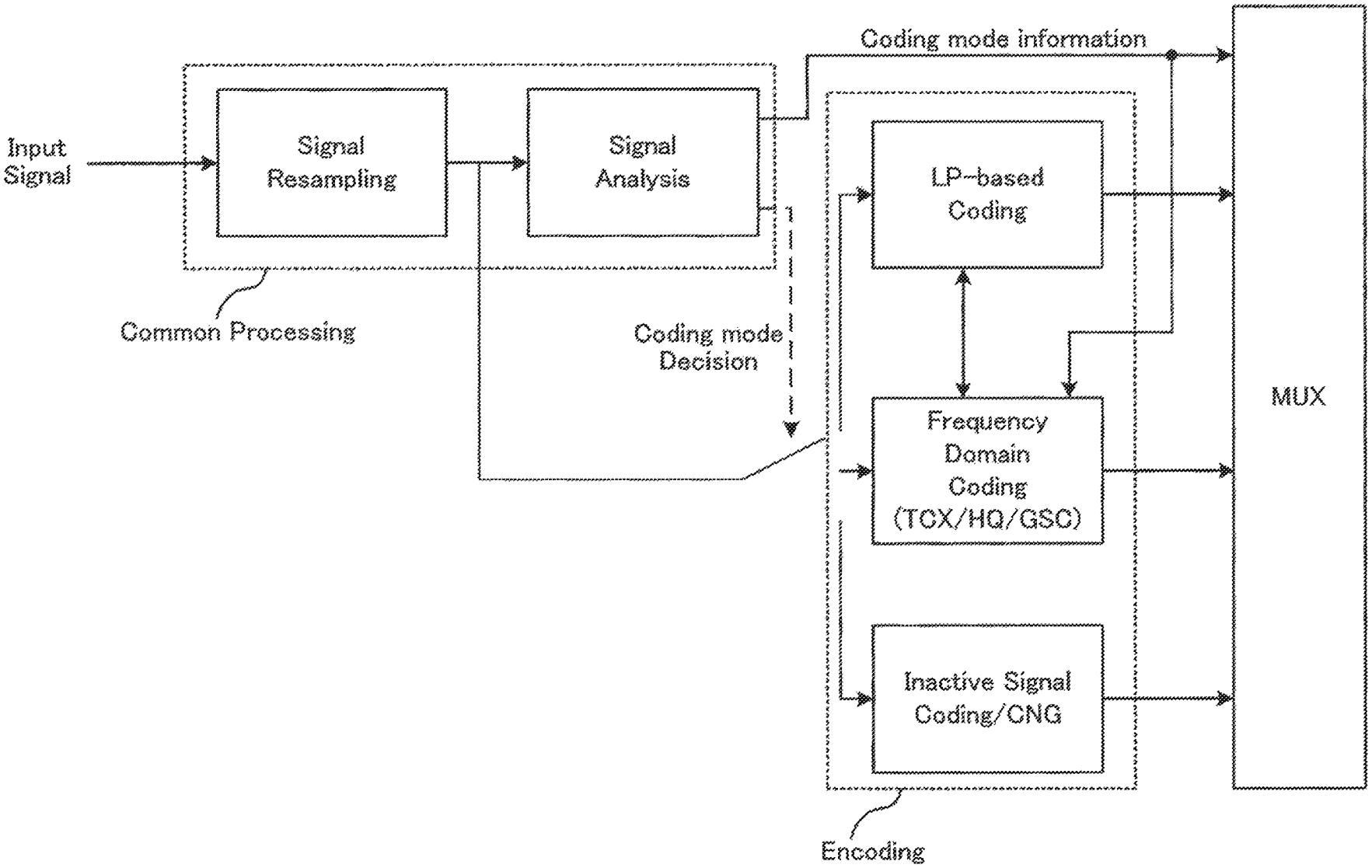
FIG. 1 is a diagram illustrating an example of an EVS codec.

As described in NPL 1, the EVS codec employs a plurality of encoding techniques (coding modes) (refer to, for example, FIG. 1). The plurality of encoding techniques employed in the EVS codec are basically based on the following two principles. One is a linear prediction (LP) based approach, and the other is a frequency domain approach. In linear prediction-based coding, a coding mode (for example, ACELP (Algebraic CELP)) optimized for each of bit rates is employed on the basis of the CELP (Code Excited Linear Prediction) coding technology. In the frequency domain approach, the HQ MDCT (High Quality Modified Discrete Cosine Transform) technology or the TCX (Transformed Code Excitation) technology is employed.

In the EVS codec, the most suitable coding mode is selected from among, for example, ACELP, HQ MDCT, and TCX in accordance with an input speech/audio signal. Each of the coding modes is designed and adjusted such that various signals can be efficiently coded. The coding mode selection in the EVS codec is made on the basis of, for example, the bit rate, the bandwidth of the audio signal, the speech/music classification, the selected coding mode, or other parameters (the features). FIG. 2 illustrates, as an example, a correspondence between each of parameters indicating the bit rate ([kbps]), bandwidth (SWB (super wideband), FB (fullband)), and input signal type (speech/audio) and one of the coding modes (ACELP, GSC, TCX, and HQ MDCT) to be selected according to the parameter.

As described above, the EVS codec is a monaural codec. However, if each channel of the stereo signal is processed by using a monaural codec, the EVS codec can be employed in a stereo rendering system. As an example, FIG. 3 illustrates an example of a configuration example of dual mono encoding (a dual mono encoder) for processing each of the channels (L channel and R channel) of a stereo signal by using a monaural codec.

Figure 3:
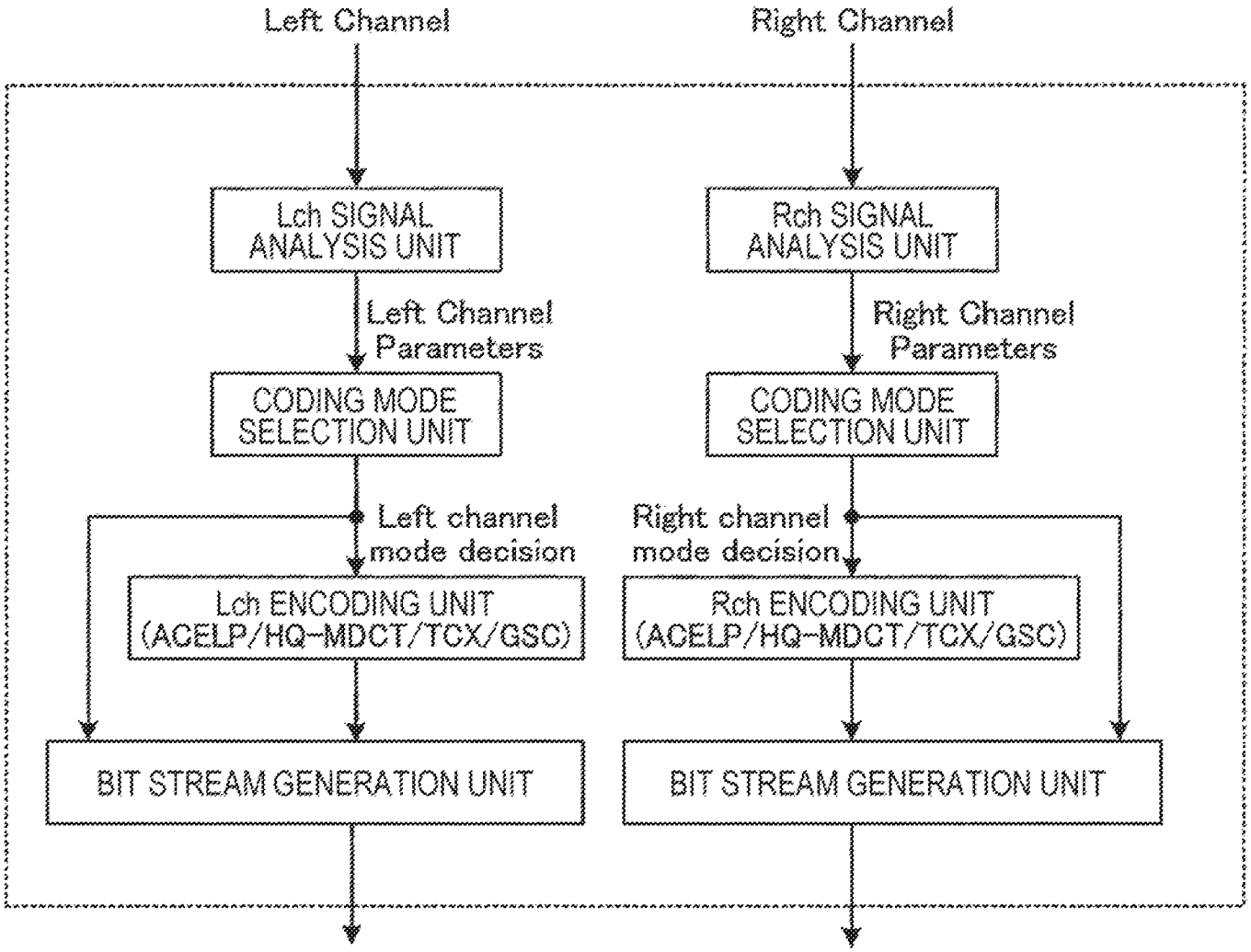
FIG. 3 is a diagram illustrating a configuration example of dual mono encoding.

As illustrated in FIG. 3, the left channel signal (hereinafter referred to as an "L channel signal") and the right channel signal (hereinafter referred to as an "R channel signal") of a stereo signal are individually encoded by using a monaural codec. In this case, different coding modes may be selected for the L channel and the R channel of the stereo signal, and the stereo signal may be encoded.

For example, if the ratio of the environmental sound (ambient noise) level (the environmental sound component energy) to the input signal level of the L channel of the stereo signal differs from that of the R channel and if the two channel signals are separately processed using a multi-mode codec, such as the EVS codec, signal analysis and selection of a coding mode are independently performed on each of the channel signals. Accordingly, different coding modes may be selected for the two channels. If different coding modes are selected for the two channels, the subjective quality of the decoded signal may deteriorate, which causes abnormal sound and/or distortion in stereo reproduction or causes an inadequate stereo soundstage.

Accordingly, in each of the embodiments of the present disclosure, a method is described for preventing deterioration of the sound quality in stereo reproduction (preventing abnormal sound and/or distortion and an inadequate stereo soundstage) even when dual mono encoding using a multi-mode codec is performed on a stereo signal having a difference in environmental sound component energy ratio between the two channels.

First Embodiment

[Outline of Communication System]

A communication system according to the present embodiment includes an encoder 100 and a decoder (not illustrated).

Figure 4:
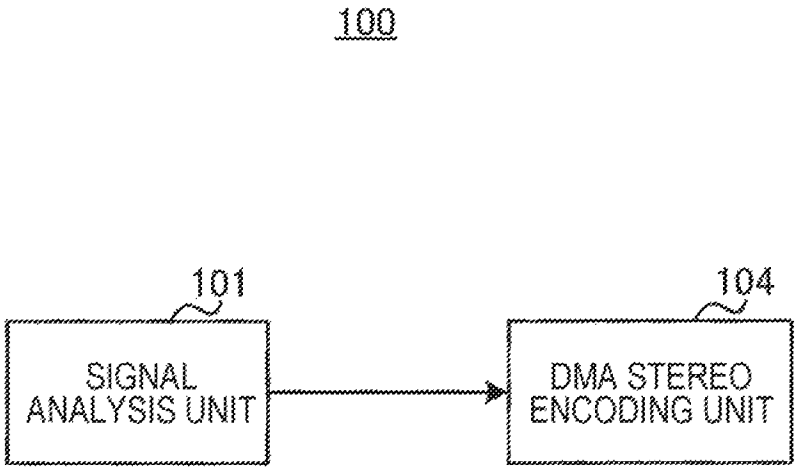
FIG. 4 is a block diagram illustrating a configuration example of part of an encoder according to a first embodiment.

FIG. 4 is a block diagram illustrating a partial configuration of the encoder 100 according to the present embodiment. In the encoder 100 illustrated in FIG. 4, the signal analysis unit 101 performs signal analysis on the L channel signal and R channel signal that constitute the stereo signal and generates a parameter (an analysis parameter, the feature) for determining the coding mode of each of the L channel and R channel. A DMA stereo encoding unit 104 encodes each of the L channel signal and R channel signal by using a coding mode common to the L channel signal and R channel signal. At this time, the DMA stereo encoding unit 104 determines the common coding mode by selecting, out of the L channel and the R channel, the one that has a lower ratio of energy of an environmental sound component to the entire energy of the channel and using the parameter of the selected channel.

[Configuration of Encoder]

Figure 5:
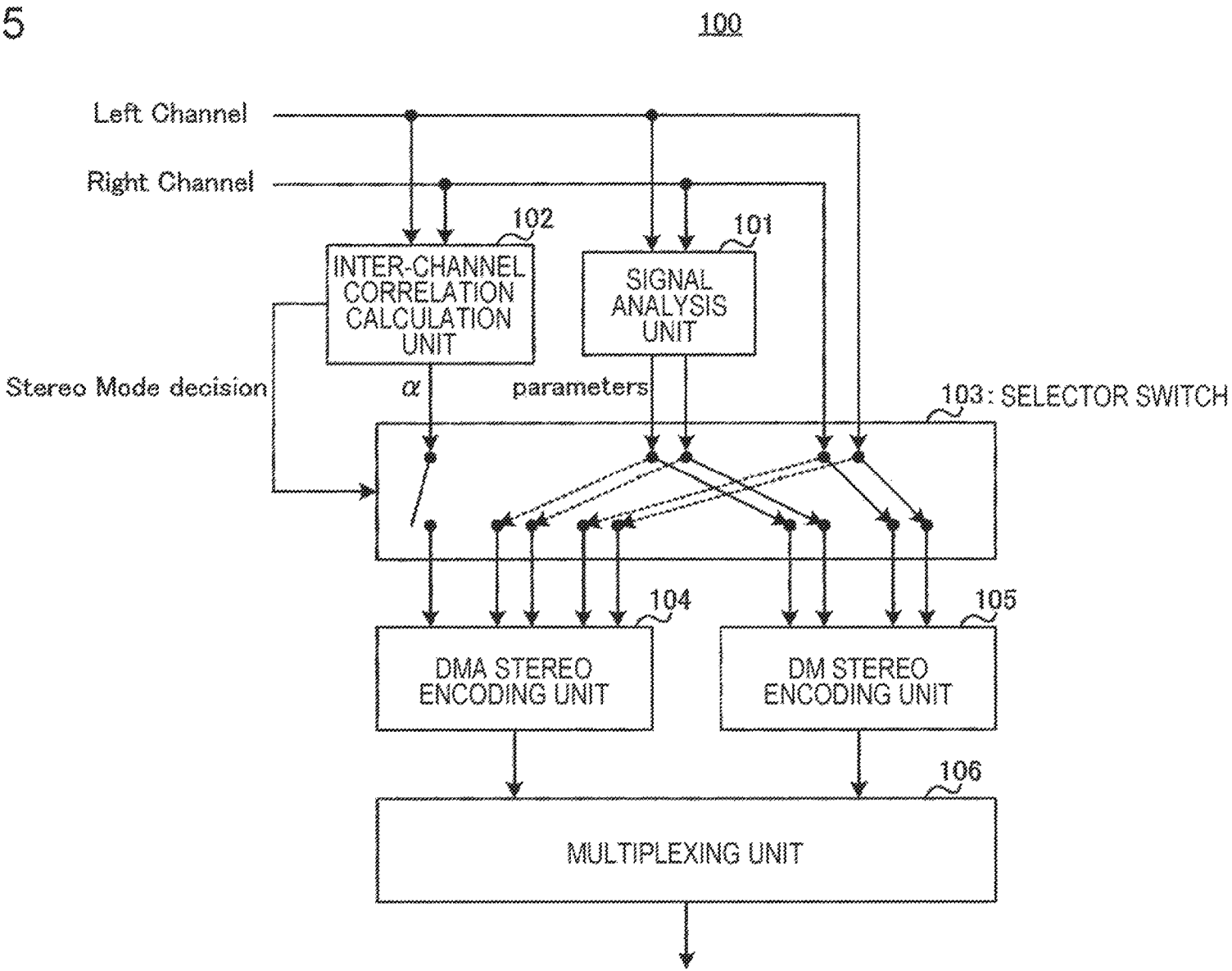
FIG. 5 is a block diagram illustrating a configuration example of the encoder according to the first embodiment.

FIG. 5 is a block diagram illustrating a configuration example of the encoder 100 according to the present embodiment. In FIG. 5, the encoder 100 includes a signal analysis unit 101, the inter-channel correlation calculation unit 102, a selector switch 103, the DMA (Dual Mono with mode alignment) stereo encoding unit 104, and the DM (Dual Mono) stereo encoding unit 105, and a multiplexing unit 106.

In FIG. 5, the L channel signal (Left channel) and the R channel signal (Right channel) that constitute a stereo signal are input to the signal analysis unit 101, the inter-channel correlation calculation unit 102, and the selector switch 103.

The signal analysis unit 101 performs signal analysis on the input L channel signal and R channel signal and obtains parameters necessary for determining the coding mode for each of the L channel and the R channel (for example, the features, such as the type of the input signal (e.g., speech/music), the bandwidth, the estimated segmental S/N ratio, long-term prediction parameters, voiced scale, spectral noise floor, high-frequency energy, voiced determination, high-frequency sparseness, average energy, and peak-to-average ratio). The signal analysis unit 101 outputs the obtained analysis parameters to the selector switch 103. For example, during the signal analysis, the signal analysis unit 101 performs frequency domain transform processing and energy calculation processing on the channel signals, for example.

The inter-channel correlation calculation unit 102 calculates the inter-channel correlation (a normalized correlation coefficient (hereinafter simply referred to as a "correlation coefficient")) $\alpha$ between the L channel and the R channel on the basis of the input L channel signal and R channel signal by using, for example, the following equation (1):

[Formula 1]

$$\alpha = \frac{R_{12}}{(\sqrt{R_{11}})(\sqrt{R_{12}})} = \frac{\left|\sum_{k=1}^{Frame_{length}} l(k)R^*(k)\right|}{\left(\sqrt{\sum_{k=1}^{Frame_{Length}} l(k)l^*(k)}\right)\left(\sqrt{\sum_{k=1}^{Frame_{Length}} R(k)R^*(k)}\right)}, \quad (1)$$

where $0<\alpha<1$.

In equation (1), $R_{11}$ represents the auto-correlation coefficient (the energy) of the L channel signal, and $R_{22}$ represents the auto-correlation coefficient (the energy) of the R channel signal. In addition, $R_{12}$ represents the correlation coefficient (the cross-spectrum) between the L channel signal and the R channel signal. Furthermore, $Frame_{length}$ represents the number of frequency spectrum parameters (the spectral coefficient) in the frame, I(k) represents the kth spectral coefficient in the L channel signal, and R(k) represents the kth spectral coefficient in the R channel signal.

In addition, the inter-channel correlation calculation unit 102 determines a stereo coding mode for the stereo signal (the L channel signal and R channel signal) on the basis of the calculated correlation coefficient α.

As used herein, as illustrated in FIG. 3, examples of the stereo coding mode include a mode in which the coding mode is individually selected for the L channel signal and the R channel signal (hereinafter referred to as a "dual mono encoding mode" or a "DM stereo coding mode") and, as is described later, a mode in which a common coding mode is selected for the L channel signal and the R channel signal, and the signals are encoded (hereinafter referred to as a "common dual mono encoding mode" or a "DMA stereo coding mode").

More specifically, the inter-channel correlation calculation unit 102 selects the DM stereo coding mode if the correlation coefficient α is less than or equal to a threshold value and selects the DMA stereo coding mode if the correlation coefficient α is greater than the threshold value. As an example, the inter-channel correlation calculation unit 102 may select the DM stereo coding mode if the correlation coefficient α is 0 (that is, if there is no correlation between the L channel signal and the R channel signal) and may select the DMA stereo coding mode if the correlation coefficient α is greater than 0 ($\alpha>0$).

The inter-channel correlation calculation unit 102 outputs, to the selector switch 103, the correlation coefficient α and a stereo mode decision flag (stereo mode decision) that is a determination result of the stereo coding mode.

If the stereo mode decision flag input from the inter-channel correlation calculation unit 102 indicates the DMA stereo coding mode, the selector switch 103 outputs, to the DMA stereo encoding unit 104, the input L channel signal, the R channel signal, the analysis parameters input from the signal analysis unit 101, and the correlation coefficient α input from the correlation calculation unit 101. However, if the stereo mode decision flag indicates the DM stereo coding mode, the selector switch 103 outputs, to the DM stereo encoding unit 105, the L channel signal, the R channel signal, and the analysis parameters.

The DMA stereo encoding unit 104 determines (selects) a common coding mode for the L channel signal and the R channel signal by using the correlation coefficient α and the analysis parameters. Thereafter, the DMA stereo encoding unit 104 encodes the L channel signal and the R channel signal by using the determined common coding mode and outputs the generated encoded bit streams to the multiplexing unit 106. A method for selecting the coding mode performed by the DMA stereo encoding unit 104 is described in more detail below.

The DM stereo encoding unit 105 determines (selects) a coding mode for each of the L channel signal and the R channel signal by using the analysis parameters. Thereafter, the DM stereo encoding unit 105 encodes each of the L channel signal and the R channel signal by using the determined coding mode and outputs the generated encoded bit stream to the multiplexing unit 106 (refer to, for example, FIG. 3).

The multiplexing unit 106 multiplexes the encoded bit streams input from the DMA stereo encoding unit 104 or the DM stereo encoding unit 105. The multiplexed bit stream is transmitted to a decoder (not illustrated).

Note that instead of including the selector switch 103, the DMA stereo encoding unit 104, and the DM stereo encoding unit 105, the encoder 100 illustrated in FIG. 5 may be configured to include an encoding unit (not illustrated) having a function of these constituent units. That is, the encoding unit is only required to determine a stereo coding mode (the DMA stereo encoding or the DM stereo encoding) in accordance with the inter-channel correlation (the correlation coefficient α) received from the inter-channel correlation calculation unit 102 and encode each of the L channel signal and R channel signal that constitute the stereo signal by using the determined stereo coding mode.

[Operation Performed by DMA Stereo Encoding Unit 104]

The method for selecting a coding mode in the DMA stereo encoding unit 104 is described in detail below.

Figure 6:
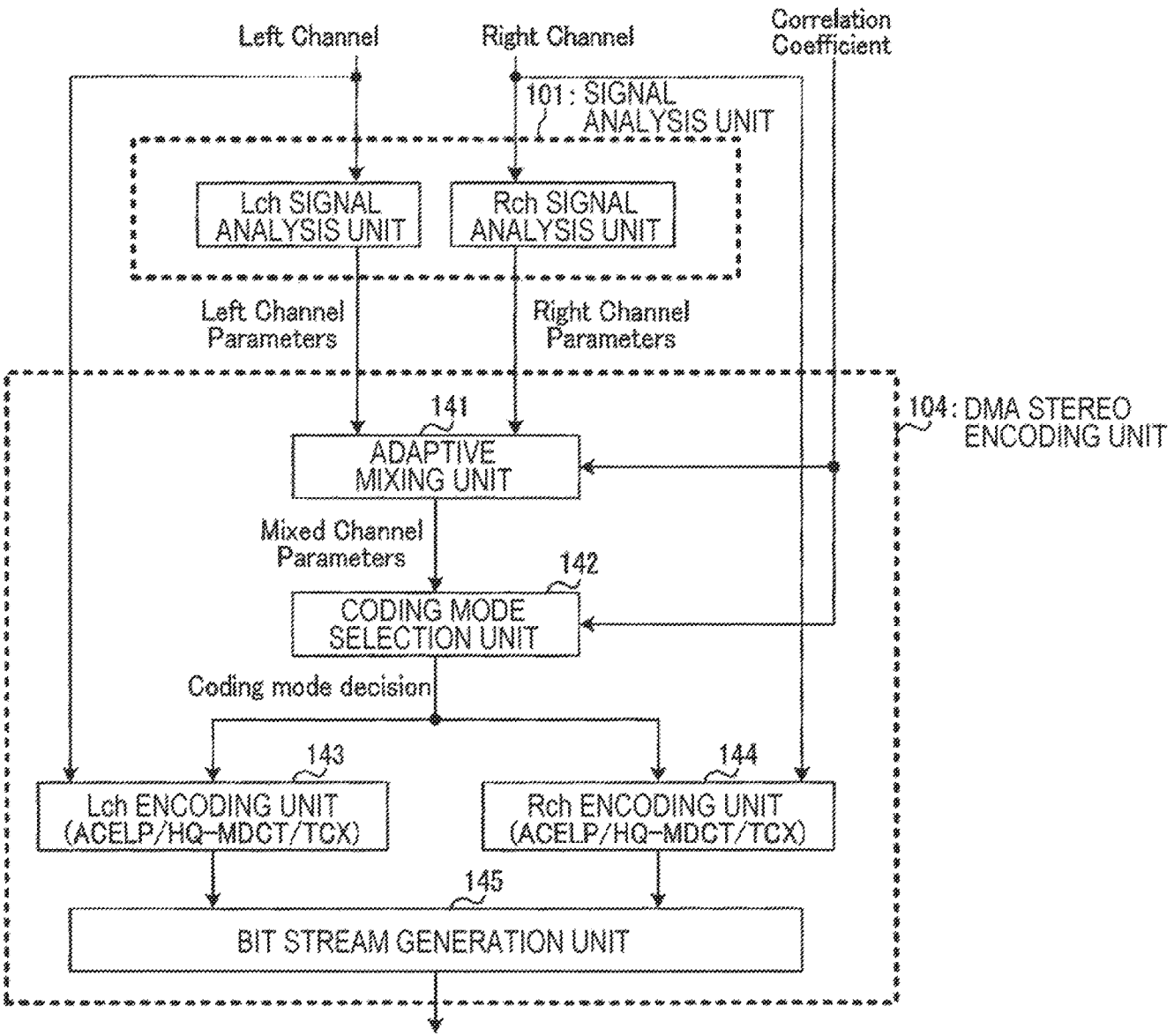
FIG. 6 is a block diagram illustrating a configuration example of a signal analysis unit and a DMA stereo encoding unit according to the first embodiment.

FIG. 6 is a block diagram illustrating the configuration of the signal separating unit 101 and the DMA stereo encoding unit 104 illustrated in FIG. 5. In FIG. 6, the DMA stereo encoding unit 104 is configured to include an adaptive mixing unit 141, a coding mode selection unit 142, an Lch encoding unit 143, an Rch encoding unit 144, and a bit stream generation unit 145.

As illustrated in FIG. 6, the adaptive mixing unit 141 receives the Lch analysis parameters (Left channel parameters) obtained by performing signal analysis on the L channel signal in the signal analysis unit 101 (an Lch signal analysis unit) via the selector switch 103 (not illustrated). Similarly, as illustrated in FIG. 6, the adaptive mixing unit 141 receives the Rch analysis parameters (Right channel parameters) obtained by performing signal analysis on the R channel signal in the signal analysis unit 101 (an Rch signal analysis unit) via the selector switch 103 (not illustrated).

The adaptive mixing unit 141 performs mixing on the Lch analysis parameters and Rch analysis parameters input from the signal analysis unit 101 on the basis of the correlation coefficient α input from the inter-channel correlation calculation unit 102 (refer to FIG. 5) and outputs the analysis parameters after the mixing (Mixed channel parameters) to the coding mode selection unit 142. That is, the analysis parameters after the mixing represent common parameters (characteristics) for determining the coding mode for each of the L channel signal and the R channel signal.

The coding mode selection unit 142 uses the analysis parameters after the mixing, input from the adaptive mixing unit 141 and selects a coding mode to be commonly applied to both the L channel signal and R channel signal. The method for selecting a coding mode in the coding mode selection unit 142 may be the same as the selection method employed in the EVS codec (monaural encoding) illustrated in FIG. 2 in accordance with the analysis parameters after the mixing, for example. The coding mode selection unit 142 outputs coding mode information (coding mode decision) indicating the selected coding mode to the Lch encoding unit 143 and the Rch encoding unit 144.

The Lch encoding unit 143 encodes the L channel signal by using the coding mode indicated by the coding mode information input from the coding mode selection unit 142 and outputs a generated encoded bit stream to the bit stream generation unit 145.

The Rch encoding unit 144 encodes the R channel signal by using the coding mode indicated by the coding mode information input from the coding mode selection unit 142 and outputs a generated encoded bit stream to the bit stream generation unit 145.

The bit stream generation unit 145 generates a stereo encoded bit stream by using the encoded bit stream input from the Lch encoding unit 143 and the encoded bit stream input from the Rch encoding unit 144 and outputs the stereo encoded bit stream to the multiplexing unit 106 (refer FIG. 5).

Figure 7:
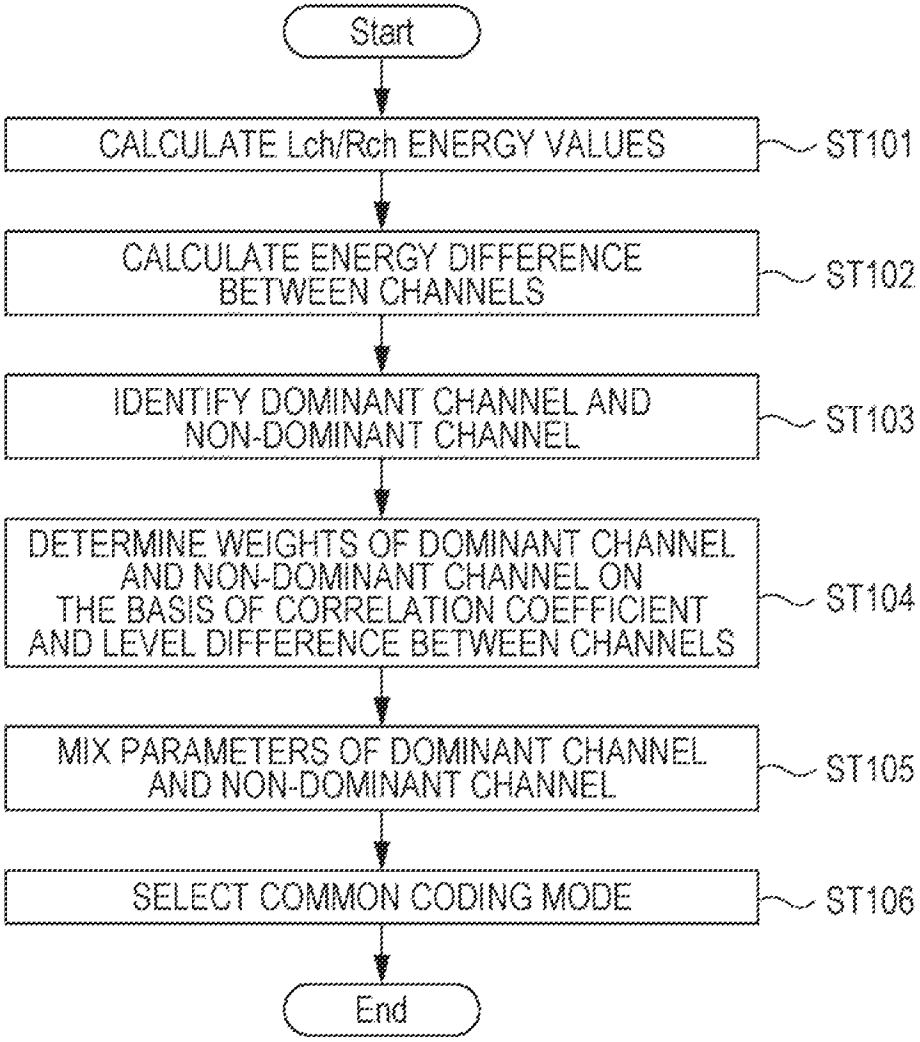
FIG. 7 is a flowchart illustrating the flow of coding mode selection processing according to the first embodiment.

FIG. 7 is a flowchart illustrating a main flow of the coding mode selection processing in the DMA stereo coding mode according to the present embodiment.

The signal analysis unit 101 (the Lch signal analysis unit and Rch analysis unit) calculates the energy of the L channel signal and the energy of the R channel signal (ST101). Subsequently, the adaptive mixing unit 141 calculates inter-channel energy difference Δ by using the energy of each of the channels calculated in ST101 (ST102).

Subsequently, the adaptive mixing unit 141 identifies a dominant channel and a non-dominant channel for the L channel signal and the R channel signal (ST103).

For example, the adaptive mixing unit 141 may identify the dominant channel and the non-dominant channel on the basis of the inter-channel energy difference Δ calculated in ST102. For example, the inter-channel energy difference Δ is given by the following equation (2):

[Formula 2]

$$\Delta = R_{11} - R_{22} \quad (2).$$

In equation (2), let $R_{11}$ denote the energy of the L channel, and let $R_{22}$ denote the energy of the R channel. Then, the adaptive mixing unit 141 identifies the dominant channel and the non-dominant channel in accordance with the sign of the inter-channel energy difference Δ. More specifically, if the energy difference Δ is positive (Δ>0, that is, $R_{11}>R_{22}$), the adaptive mixing unit 141 identifies that the L channel is the dominant channel, and the R channel is the non-dominant channel. However, if the energy difference Δ is negative (Δ<0, that is, $R_1<R_{22}$), the adaptive mixing unit 141 identifies that the L channel is a non-dominant channel, and the R channel is a dominant channel.

In addition, if the energy difference Δ is 0 (Δ=0, that is, $R_{11}=R_{22}$), the adaptive mixing unit 141 may identify either the L channel or the R channel as the dominant channel. For example, if the energy difference Δ is positive, the adaptive mixing unit 141 may identify the L channel as the dominant channel. However, if the energy difference Δ is less than or equal to 0 (Δ≤0), the adaptive mixing unit 141 may identify the R channel as the dominant channel. Alternatively, if the energy difference Δ is negative, the adaptive mixing unit 141 may identify the R channel as the dominant channel. However, if the energy difference Δ is greater than or equal to 0 (Δ≥0), the adaptive mixing unit 141 may identify the L channel as the dominant channel.

Note that the technique for identifying the dominant channel and the non-dominant channel is not limited to the above-described technique.

Subsequently, the adaptive mixing unit 141 determines a weighting coefficient (a weight) for each of the analysis parameter of the dominant channel and the analysis parameter of the non-dominant channel identified in ST103 on the basis of the correlation coefficient α and the level difference between the channels (the energy difference) (ST104). That is, the adaptive mixing unit 141 calculates the weighting coefficient for the analysis parameter of each of the channels on the basis of the ratio of the energy of the environmental sound component to the entire energy of each of the channels (the details are described below).

Thereafter, the adaptive mixing unit 141 performs mixing (adaptive mixing) of the analysis parameters by calculating the weighted sum of the analysis parameter of the dominant channel and the analysis parameter of the non-dominant channel by using the weighting coefficients determined in ST104 (ST105).

For example, the adaptive mixing unit 141 performs mixing of the analysis parameters (calculates the weighted sum) to obtain an analysis parameter (a weighted parameter) $M_p$ by using the following equation (3):

[Formula 3]

$$M_p = W_1 D_p + W_n N D_p \quad (3).$$

In equation (3), $D_p$ represents an analysis parameter for determining the coding mode of the dominant channel, and $ND_p$ represents an analysis parameter for determining the coding mode of the non-dominant channel. $W_1$ represents a weighting coefficient for the analysis parameter of the dominant channel, and $W_2$ represents a weighting coefficient for the analysis parameter of the non-dominant channel.

Finally, the coding mode selection unit 142 selects a coding mode common to both the L channel signal and the R channel signal by using the analysis parameter $M_p$ obtained in ST105 (ST106). The method for selecting a coding mode employed by the coding mode selection unit 142 may be the same as the selection method in the EVS codec (monaural encoding) illustrated in FIG. 2.

The method for calculating the weighting coefficient in ST104 is described below.

In the method, it is assumed that, each of the input signals input to the encoder 100 consists of an environmental sound component common to the two channels (components having the same level and having no correlation with each other) and a component other than the environmental sound component (components common to the two channels but having different amplitudes and phases).

In this case, the adaptive mixing unit 141 obtains the energy A of the environmental sound component estimated from the input signals of the two channels (that is, the L channel and R channel) by using the following equation (4):

[Formula 4]

$$A = \frac{P_{X_L} + P_{X_R} - \sqrt{(P_{X_L} + P_{X_R})^2 - 4(1-\alpha^2)P_{X_L}P_{X_R}}}{2}. \quad (4)$$

In Equation (4), $P_{XL}$ represents the energy of the L channel signal, $P_{XR}$ represents the energy of the R channel signal, and a represents the inter-channel correlation (the normalized correlation coefficient) given by equation (1).

Note that the energy A of the environmental sound component given by equation (4) can be calculated even before the process of identifying the dominant channel and the non-dominant channel (the process in ST103). That is, either the process of calculating the energy A or the process of identifying the dominant channel and the non-dominant channel) may be performed first.

Subsequently, the adaptive mixing unit 141 calculates the environmental sound component energy ratio $AE_{ND}$ (the ratio of the energy of the environmental sound component to the entire energy of the non-dominant channel identified in ST103) by using the following equation (5):

[Formula 5]

$$AE_{ND} = \frac{A}{P_{ND}} = \frac{P_{X_L} + P_{X_R} - \sqrt{(P_{X_L} + P_{X_R})^2 - 4(1-\alpha^2)P_{X_L}P_{X_R}}}{2P_{ND}}. \quad (5)$$

In equation (5), $P_{ND}$ represents the energy of the non-dominant channel signal. $P_{ND}$ is the same as $P_{XL}$ or $P_{XR}$.

Figure 8:
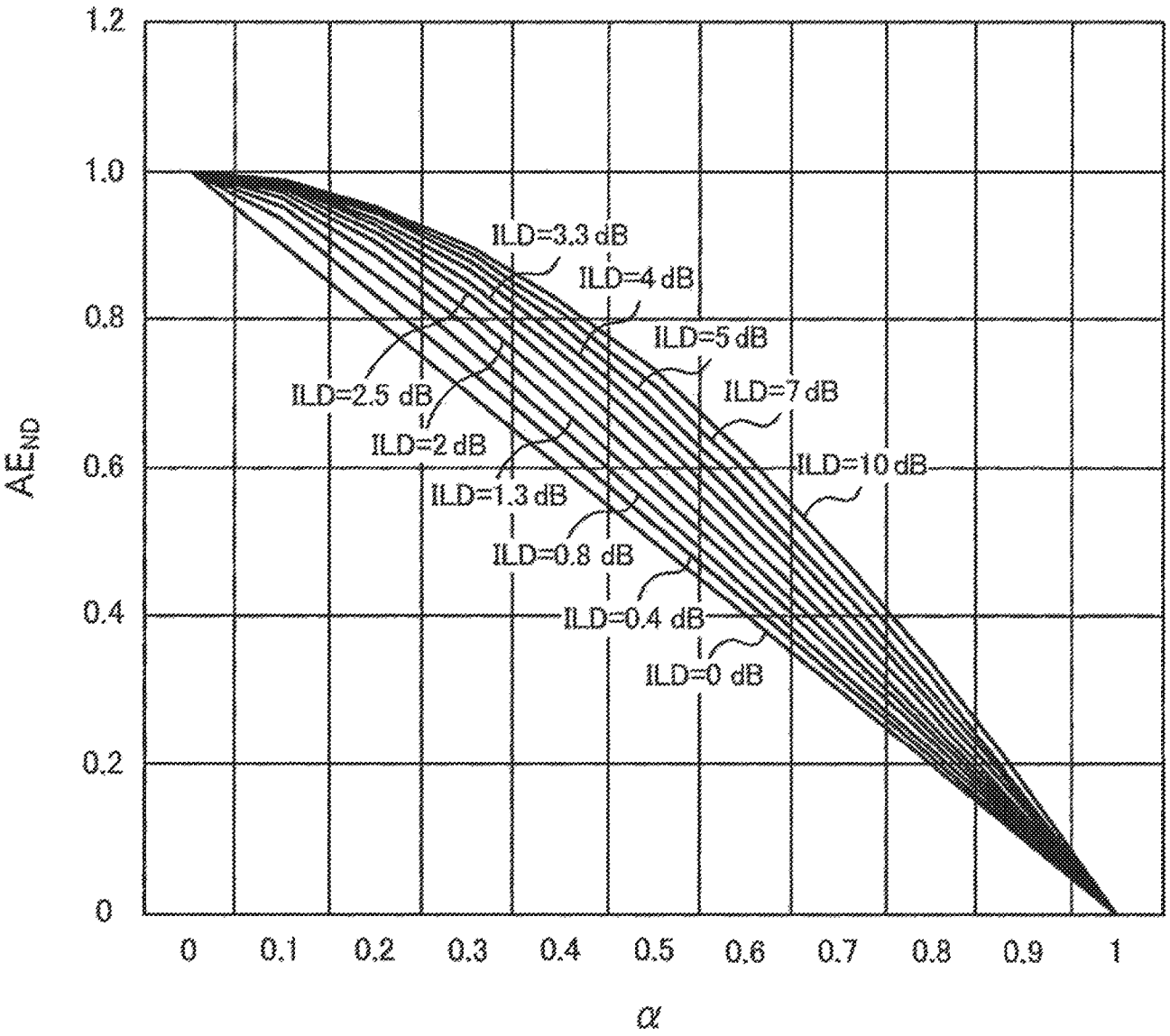
FIG. 8 is a diagram illustrating an example of the relationship between an inter-channel correlation and the environmental sound component energy of a non-dominant channel signal according to the first embodiment.

FIG. 8 illustrates an example of the relationship between the inter-channel correlation (the correlation coefficient) a and the environmental sound component energy (estimated environmental sound component energy) ratio $AE_{ND}$ for the non-dominant channel. From FIG. 8 and equation (5), the environmental sound component energy ratio $AE_{ND}$ for the non-dominant channel is 0 when $\alpha=1$ and is 1 when $\alpha=0$. The environmental sound component energy ratio $AE_{ND}$ decreases from 1 to 0 with increasing a.

Note that it is assumed that the environmental sound components of the two channels are the same (the energy is the same) and have no correlation with each other. Therefore, when $\alpha=0$ ($AE_{ND}=1$), the whole non-dominant channel signal is an environmental sound component. When $\alpha=1$ ($AE_{ND}=0$), the non-dominant channel signal do not include an environmental sound component.

In addition, since the energy of the dominant channel signal is larger than the energy of the non-dominant channel signal, the environmental sound component energy ratio of the dominant channel is lower than the environmental sound component energy ratio $AE_{ND}$ of the non-dominant channel under the above-described assumption that the environmental sound component is common to the channels. That is, the reliability of the coding mode selected using the dominant channel signal (the analysis parameter) is higher than at least the reliability of the coding mode selected using the non-dominant channel signal (the analysis parameter).

In contrast, the ratio of principal component signals, such as speech/audio signals, in the non-dominant channel decreases with increasing environmental sound component energy ratio $AE_{ND}$ of the non-dominant channel. Therefore, the reliability of the coding mode selected using the non-dominant channel signal (the analysis parameter) decreases with increasing environmental sound component energy ratio $AE_{ND}$ of the non-dominant channel.

For this reason, according to the present embodiment, to determine a common coding mode, the adaptive mixing unit 141 preferentially uses the analysis parameter of the dominant channel (the L channel or R channel) that has a lower ratio of the energy of the environmental sound component to the entire energy of the channel. In addition, when determining a common coding mode, the adaptive mixing unit 141 decreases the degree of enhancement of the analysis parameter of the non-dominant channel with increasing environmental sound component energy ratio $AE_{ND}$ of the non-dominant channel.

For example, the adaptive mixing unit 141 calculates a weighting coefficient for the analysis parameter used to determine the coding mode on the basis of the environmental sound component energy ratio $AE_{ND}$ of the non-dominant channel. For example, the adaptive mixing unit 141 obtains a weighting coefficient $W_1$ for the analysis parameter of the dominant channel by using the following equation (6) and obtains a weighting coefficient $W_2$ for the analysis parameter of the non-dominant channel by using the following equation (7):

[Formula 6]

$$W_1 = \frac{AE_{ND} + 1}{2}, \text{ and} \quad (6)$$

[Formula 7]

$$W_2 = 1 - W_1. \quad (7)$$

As can be seen from equations (5), (6), and (7), when $\alpha=1$ ($AE_{ND}=0$), the weighting coefficient $W_1$ for the analysis parameter of the dominant channel=0.5, and the weighting coefficient $W_2$ for the analysis parameter of the non-dominant channel=0.5. That is, in the weighting parameter $M_p$ given by equation (3), the weight for the analysis parameter $D_p$ of the dominant channel and the weight for the analysis parameter $ND_p$ of the non-dominant channel are the same. This is because when $\alpha=1$ ($AE_{ND}=0$), the non-dominant channel does not include an environmental sound component and, thus, the reliability of the coding mode determined using the non-dominant channel signal increases.

In contrast, as can be seen from equations (5), (6), and (7), when $\alpha=0$ ($AE_{ND}=1$), the weighting coefficient $W_1$ for the analysis parameter of the dominant channel=1, and the weighting coefficient $W_2$ for the analysis parameter of the non-dominant channel=0. That is, the weighting parameter $M_p$ given by equation (3) consists of the analysis parameter $D_p$ of the dominant channel and does not include the analysis parameter $ND_p$ of the non-dominant channel. This is because when $\alpha=0$ ($AE_{ND}=1$), the non-dominant channel includes only environmental sound components and does not include principal component signals, such as speech/audio signals, and, thus, the reliability of the coding mode determined using the non-dominant channel signal decreases.

That is, the weighting coefficient $W_1$ is in the range of 0.5 to 1, and the weighting coefficient $W_2$ is in the range of 0.5 to 0. In addition, the weighting coefficient $W_1 \geq$ the weighting coefficient $W_2$. That is, the adaptive mixing unit 141 determines the analysis parameter $M_P$ by setting the weighting coefficient $W_1$ of the analysis parameter of the dominant channel to a value greater than or equal to the weighting coefficient $W_2$ of the analysis parameter of the non-dominant channel. In this manner, the analysis parameter $M_p$ used to determine the common coding mode is easily set to a value that emphasizes the analysis parameter of the dominant channel more. As described above, the encoder 100 can appropriately select the common coding mode by preferentially using the analysis parameter of the dominant channel with higher reliability (the channel with a lower environmental sound component energy ratio). Thus, deterioration of the sound quality during stereo reproduction can be reduced.

In addition, since the reliability of the coding mode determined using the analysis parameter of the non-dominant channel decreases with increasing environmental sound component energy ratio $AE_{ND}$ of the non-dominant channel, the encoder 100 performs weighting so as to prioritize (emphasize) the dominant channel more. In this way, the encoder 100 ensures that a higher weight is given to the analysis parameter of the dominant channel having high reliability. In addition, the encoder 100 adjusts the weighting emphasis level for the analysis parameter of each of the channels in accordance with the environmental sound component energy ratio $AE_{ND}$ of the non-dominant channel and, thus, appropriately selects the common coding mode. In this manner, deterioration of the sound quality during stereo reproduction can be reduced.

Note that the environmental sound component energy ratio $AE_{ND}$ of the non-dominant channel given by the equation (5) can be expressed as the following equation (8) using a level ratio (a level difference) k between the L channel and the R channel:

[Formula 8]

$$\begin{aligned} AE_{ND} &= \frac{A_D}{P_{ND}} \\ &= \frac{P_{ND} + P_D - \sqrt{(P_{ND} + P_D)^2 - 4(1-\alpha^2)P_{ND}P_D}}{2P_{ND}} \\ &= \frac{1 + \frac{P_D}{P_{ND}} - \sqrt{\left(1 + \frac{P_D}{P_{ND}}\right)^2 - 4(1-\alpha^2)\frac{P_D}{P_{ND}}}}{2} \\ &= \frac{1 + k - \sqrt{(1+k)^2 - 4(1-\alpha^2)k}}{2k}. \end{aligned} \tag{8}$$

In Equation (8), $P_D$ represents the energy of the dominant channel signal, and $P_{ND}$ represents the energy of the non-dominant channel signal. The level difference $k=(P_D/P_{ND})$. In addition, $A_D$ is the energy of the environmental sound component. In equation (8), the L channel signal energy $P_{XL}$ and the R channel signal energy $P_{XR}$ that appear in equation (4) are replaced by the dominant channel signal energy $P_D$ and the non-dominant channel signal energy $P_{ND}$.

That is, the adaptive mixing unit 141 uses an inter-channel correlation $\alpha$ between the L channel and the R channel and the level difference k between the L channel and the R channel and calculates the environmental sound component energy ratio $AE_{ND}$ of the non-dominant channel. That is, as can be seen from equation (8), the environmental sound component energy ratio $AE_{ND}$ of the non-dominant channel can be expressed as a function of the level difference k between the channels and the correlation coefficient $\alpha$.

For example, FIG. 8 illustrates the relationship between the correlation coefficient $\alpha$ and the energy ratio $AE_{ND}$ of the non-dominant channel signal when the level difference k between the channels is denoted as ILD (Inter-channel Level Difference) [dB]. As illustrated in FIG. 8, for the same correlation coefficient $\alpha$, the energy ratio $AE_{ND}$ increases with increasing level difference (ILD) between the dominant channel and the non-dominant channel. That is, for the same correlation coefficient $\alpha$, as the level difference between the channels increases, the weighting coefficient $W_1$ for the analysis parameter of the dominant channel increases and the weighting coefficient $W_2$ for the analysis parameter of the non-dominant channel decreases.

However, as described above, when $\alpha$=0 or 1, the energy ratio $AE_{ND}$ is 1 or 0 regardless of the level difference. Accordingly, as illustrated in FIG. 8, the graph denoting the relationship between the correlation coefficient $\alpha$ and the energy ratio $AE_{ND}$ has a shape that protrudes upward as the level difference increases.

At this time, under the above-described assumption that the environmental sound component is common to the channels, the level of the principal component signal, such as a speech/audio signal, of the dominant channel increases with increasing level difference k between the channels, as compared with the level of the principal component signal, such as a speech/audio signal, of the non-dominant channel. That is, the reliability of the coding mode determined using the dominant channel signal increases with increasing level difference k between the channels, as compared with the reliability of the coding mode determined using the non-dominant channel signal.

Accordingly, weighting is performed such that the dominant channel is more prioritized (emphasized) over the non-dominant channel by increasing the weighting coefficient $W_1$ and decreasing the weighting coefficient $W_2$ with increasing level difference k between the channels. Thus, the encoder 100 can appropriately select a common coding mode by using the analysis parameter of the dominant channel having high reliability when determining the common coding mode. As a result, deterioration of the sound quality at the time of stereo reproduction can be reduced.

As described above, according to the present embodiment, the encoder 100 commonalizes the coding mode used for encoding each of the channel signals if there is an inter-channel correlation for the stereo signal. In this manner, even when the subjective quality of the decoded signal deteriorates under the condition that different coding modes are selected for the two channels of the stereo signal, the encoder 100 can prevent the deterioration of the subjective quality of the decoded signal by performing encoding using the common coding mode for the two channels of the stereo signal.

In addition, when selecting a common coding mode, the encoder 100 adjusts the weights assigned to the dominant channel and non-dominant channel on the basis of the environmental sound component energy ratio of the non-dominant channel (the correlation coefficient $\alpha$ and the level difference between the channels) and mixes the analysis parameters. More specifically, the encoder 100 preferentially uses the analysis parameter of the channel having a low environmental sound component energy ratio (the dominant channel) and adjusts the degree of enhancement of the analysis parameter of each of the channels (the weighting coefficient of each of the channels) in accordance with the environmental sound component energy ratio of the non-dominant channel. In this manner, the encoder 100 can appropriately select a common coding mode in consideration of the reliability of the coding mode determined using the analysis parameter of the non-dominant channel.

As a result, according to the present embodiment, even when performing, by using a multi-mode codec, dual mono encoding on a stereo signal having a difference in the environmental sound component energy ratio between the channels, each of the channel signals can be encoded by using an appropriate coding mode and, thus, deterioration of the sound quality during stereo reproduction can be reduced.

Modification 1 of First Embodiment

According to the above-described embodiment, it is assumed that to calculate the environmental sound component energy ratio $AE_{ND}$ of the non-dominant channel given by Equation (5), the energy (the power) per frequency unit (for example, frequency bin unit) is used.

In contrast, according to Modification 1, the adaptive mixing unit 141 may use $P_{ND}$, $P_{XL}$, and $P_{XR}$ for each of the sub-bands and calculate the environmental sound component energy ratio $AE_{ND}$ of the non-dominant channel for each of the sub-bands by using the following equation (9), instead of using equation (5):

[Formula 9]

$$AE_{ND}(i) = \frac{A(i)}{P_{ND}(i)} = \frac{P_{X_L}(i) + P_{X_R}(i) - \sqrt{\begin{matrix}(P_{X_L}(i) + P_{X_R}(i))^2 - \\ 4(1-\alpha^2)P_{X_L}(i)P_{X_R}(i)\end{matrix}}}{2P_{ND}(i)}. \quad (9)$$

In equation (9), i represents a sub-band index. For example, i=1 to $N_{bands}$ ($N_{bands}$: the total number of sub-bands).

Thereafter, the adaptive mixing unit 141 can calculate the weighting coefficient for the analysis parameter of each of the dominant channel and the non-dominant channel by using equation (7) and the following equation (10):

[Formula 10]

$$W_1 = 0.5\left(1 + \frac{1}{N_{bands}}\sum_{i=1}^{N_{bands}} AE_{ND}(i)\right). \quad (10)$$

That is, according to Modification 1, the adaptive mixing unit 141 obtains a weighting coefficient from the sum of energy ratios $AE_{ND}$ calculated for all of the sub-bands.

Note that calculation of the energy ($P_{ND}$, $P_{XL}$, $P_{XR}$) of the channel signal for each of the sub-band may be performed in a process other than the analysis parameter mixing process in the coding mode determination (for example, the signal analysis process). In this case, the adaptive mixing unit 141 can calculate the weighting coefficient by using the energy ($P_{ND}$, $P_{XL}$, $P_{XR}$) of the channel signal obtained in other processing. That is, the adaptive mixing unit 141 need not calculate the channel signal energy ($P_{ND}$, $P_{XL}$, $P_{XR}$) again to calculate the weighting coefficient. As a result, according to Modification 1, the amount of calculation for obtaining the weighting coefficient can be reduced.

Modification 2 of First Embodiment

According to Modification 2, unlike Modification 1, the adaptive mixing unit 141 calculates the environmental sound component energy ratio $AE_{ND}$ of the non-dominant channel for each of the sub-bands by using the correlation coefficient $\alpha$ in addition to $P_{ND}$, $P_{XL}$, $P_{XR}$ for each of the sub-bands as follows:

[Formula 11]

$$AE_{ND}(i) = \frac{A(i)}{P_{ND}(i)} = \frac{P_{X_L}(i) + P_{X_R}(i) - \sqrt{\begin{matrix}(P_{X_L}(i) + P_{X_R}(i))^2 - \\ 4(1-\alpha(i)^2)P_{X_L}(i)P_{X_R}(i)\end{matrix}}}{2P_{ND}(i)}. \quad (11)$$

Thereafter, like Modification 1, the adaptive mixing unit 141 can calculate the weighting coefficient for the analysis parameter of each of the dominant channel and the non-dominant channel by using equation (10) and equation (7).

That is, according to Modification 2, the adaptive mixing unit 141 obtains a weighting coefficient from the sum of energy ratios $AE_{ND}$ calculated for all of the sub-bands. As a result, like Modification 1, the adaptive mixing unit 141 uses the channel signal energy ($P_{ND}$, $P_{XL}$, $P_{XR}$) obtained in other processes and, thus, need not calculate the channel signal energy ($P_{ND}$, $P_{XL}$, $P_{XR}$) to calculate the weighting coefficients. For this reason, according to Modification 2, the amount of calculation for obtaining the weighting coefficients can be reduced.

In Modifications 1 and 2, the case has been described in which the weighting coefficient is calculated from the average value of the energy ratios $AE_{ND}$ calculated for all of the sub-bands. However, the weighting coefficients may also be calculated for each of the sub-bands. For example, if the encoder 100 supports a codec that switches the coding mode for each of the sub-bands, a coding mode for each of the sub-bands can be appropriately selected on the basis of the energy ratio $AE_{ND}$ calculated for the sub-band.

Second Embodiment

If the determination result (the selection result) of the coding mode is frequently switched between frames, the subjective quality of the decoded signal may deteriorate. Therefore, according to the present embodiment, a method is described for preventing frequent switching of the coding mode determination result between frames.

[Configuration of Encoder]

An encoder according to the present embodiment has the same basic configuration as the encoder 100 according to the first embodiment and, thus, is described with reference to FIG. 5. However, according to the present embodiment, the encoder 100 includes a DMA stereo encoding unit 150 illustrated in FIG. 9 instead of the DMA stereo encoding unit 104 illustrated in FIG. 5.

Figure 9:
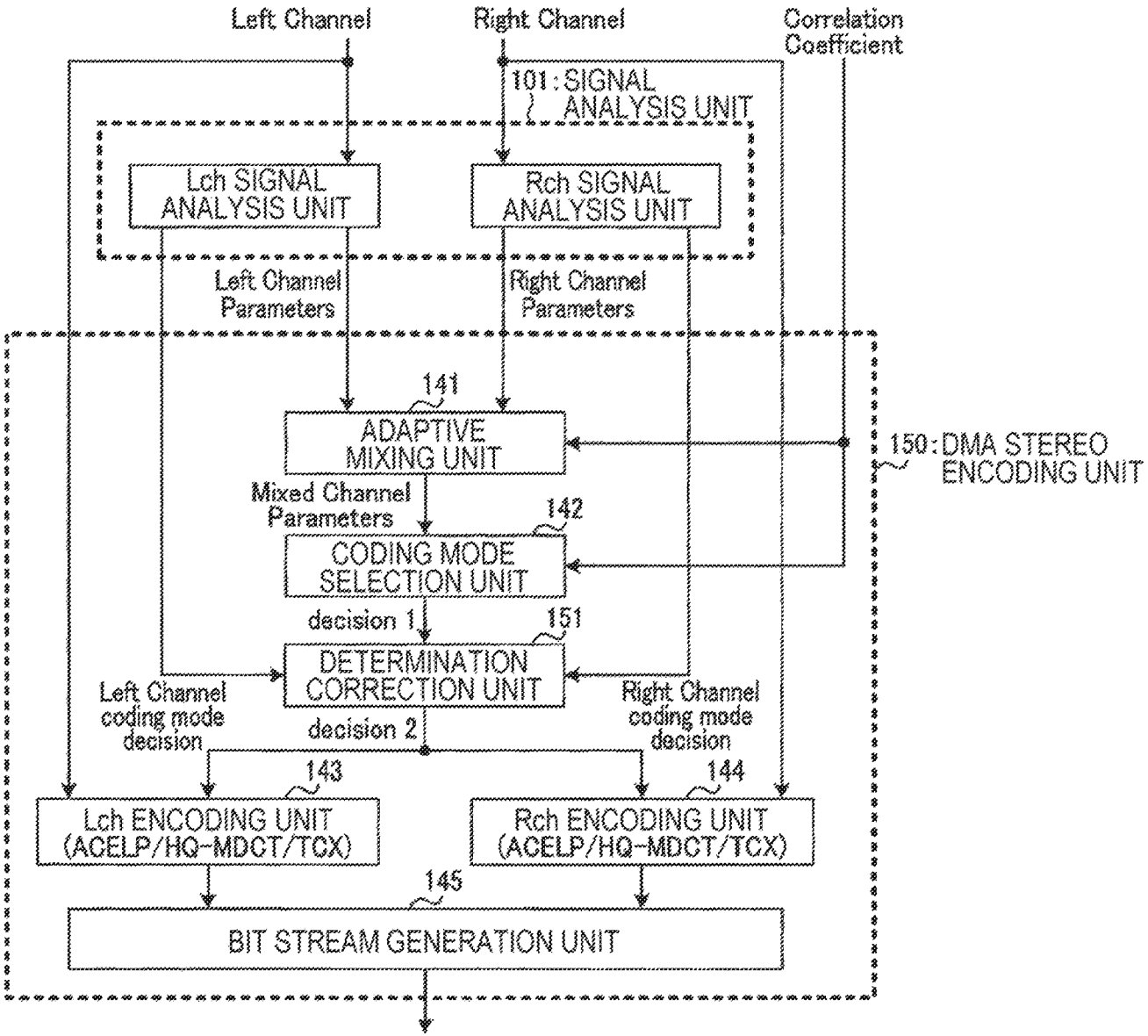
FIG. 9 is a block diagram illustrating a configuration example of a signal analysis unit and a DMA stereo encoding unit according to a second embodiment.

FIG. 9 is a block diagram illustrating a configuration example of the DMA stereo encoding unit 150 according to the present embodiment.

Note that the same reference numerals are used in FIG. 9 to describe those configurations that are identical to the configurations of the first embodiment (FIG. 6), and the description of the configurations are not repeated. More specifically, the DMA stereo encoding unit 150 illustrated in FIG. 9 further includes a determination correction unit 151, as compared with the configuration of the first embodiment (FIG. 6).

Furthermore, according to the present embodiment, in addition to performing the processes of the first embodiment, the signal analysis unit 101 (the Lch signal analysis unit) outputs, to the determination correction unit 151, an Lch coding mode determination result (Left channel coding mode decision) indicating the coding mode determined on the basis of the Lch analysis parameter (refer to, for example, FIG. 2). Similarly, in addition to performing the processes of the first embodiment, the signal analysis unit 101 (the Rch signal analysis unit) outputs, to the determination correction unit 151, an Rch coding mode determination result (Right channel coding mode decision) indicating the coding mode determined on the basis of the Rch analysis parameter (refer to, for example, FIG. 2).

In the DMA stereo encoding unit 150, the determination correction unit 151 determines whether the coding mode determination result input from the coding mode selection unit 142 is to be corrected on the basis of the coding mode applied to the previous frame and the Lch coding mode determination result and the Rch coding mode determination result input from the signal analysis unit 101.

As used herein, the coding mode input to the determination correction unit 151 is referred to as "decision 1", and the coding mode output from the determination correction unit 151 is referred to as "decision 2".

If the determination correction unit 151 determines that correction of the coding mode determination result is not needed, the determination correction unit 151 outputs the coding mode determination result to the Lch encoding unit 143 and the Rch encoding unit 144 without any correction. However, if the determination correction unit 151 determines that correction of the coding mode determination result is needed, the determination correction unit 151 corrects the coding mode determination result and outputs the corrected coding mode determination result to each of the Lch encoding unit 143 and the Rch encoding unit 144.

Figure 10:
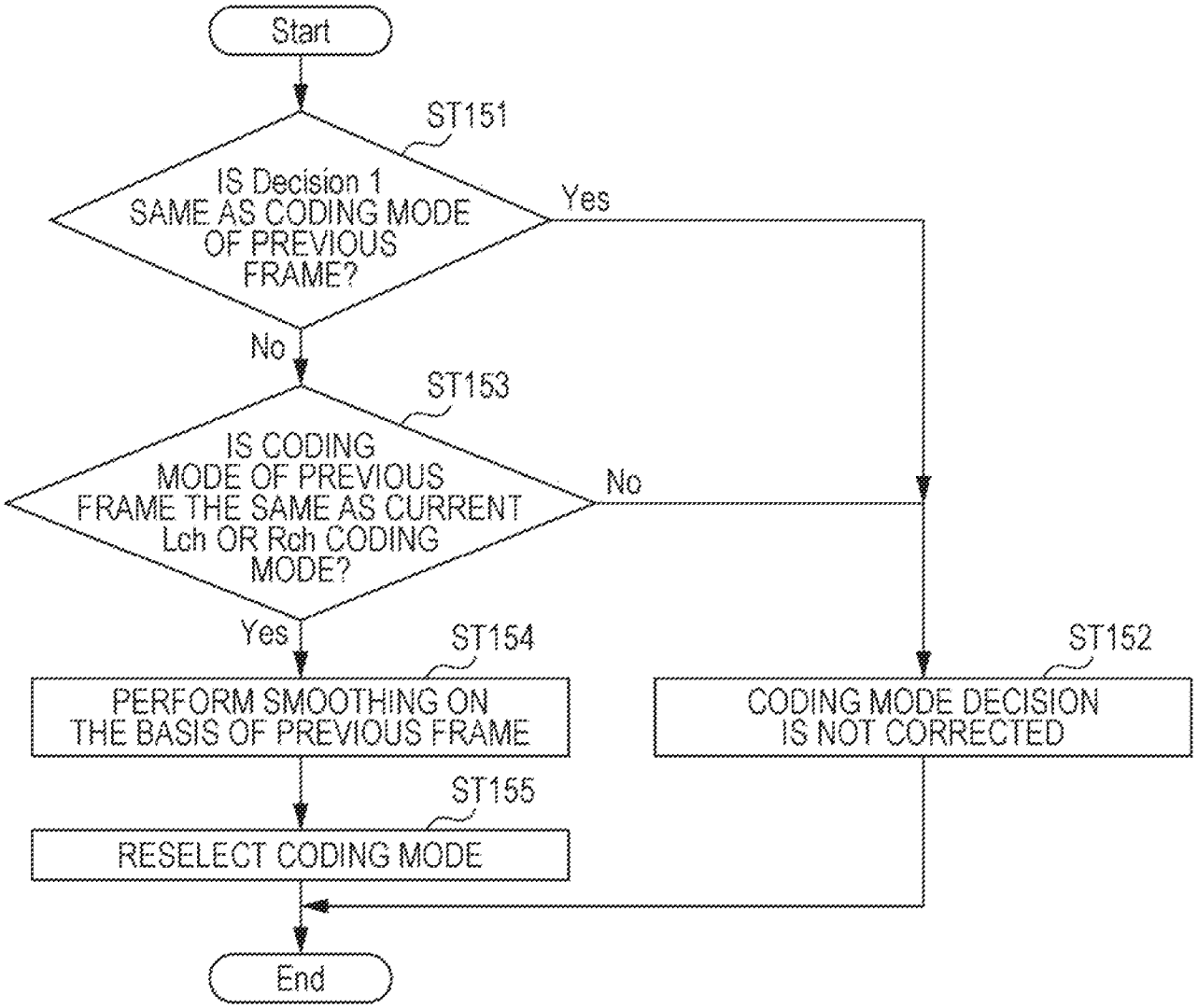
FIG. 10 is a flowchart illustrating the flow of coding mode determination correction processing according to the second embodiment.

FIG. 10 is a flowchart illustrating an example of the coding mode determination correction process performed by the determination correction unit 151.

In FIG. 10, the determination correction unit 151 determines whether the coding mode determination result (decision 1) of the current frame in the coding mode selection unit 142 is the same as the coding mode applied to a previous frame (for example, the immediately previous frame) (ST151).

If the coding mode determination result (decision 1) is the same as the coding mode of the previous frame (ST151: Yes), the determination correction unit 151 completes the processing without performing the correction process on the coding mode determination result (decision 1) (ST152).

However, if the coding mode determination result (decision 1) is not the same as the coding mode of the previous frame (ST151: No), the determination correction unit 151 determines whether the coding mode used in the previous frame (for example, the immediately previous frame) is the same as one of the Lch coding mode determination result of the current frame and the Rch coding mode determination result of the current frame (ST153).

If, in ST153, the coding mode used in the previous frame is not the same as the Lch coding mode determination result of the current frame or the Rch coding mode determination result of the current frame (ST153: No), the determination correction unit 151 completes the processing without performing the correction process on the coding mode determination result (decision 1) (ST152).

However, if the coding mode of the previous frame is the same as the Lch coding mode determination result of the current frame or the Rch coding mode determination result of the current frame (ST153: Yes), the determination correction unit 151 performs a correction process (a smoothing process) on the coding mode determination result (decision 1) by using the coding mode determination result of the current frame and the coding mode of the previous frame (ST154).

That is, if the common coding mode (decision 1) selected for the current frame differs from the common coding mode selected for the previous frame and if the common coding mode selected for the previous frame is the same as the Lch coding mode determination result of the current frame or the Rch coding mode determination result of the current frame, the determination correction unit 151 reselects (corrects) the common coding mode for the current frame.

For example, the determination correction unit 151 corrects the analysis parameter $M_P$ used in the decision-1 determination process by using the following equation (12):

[Formula 12]

$$M_p = WM_P^{[-1]} + (1-W)M_p \quad (12).$$

In equation (12), $M_P^{[-1]}$ indicates an analysis parameter $M_p$ of the immediately previous frame (the previous frame), and W indicates a smoothing coefficient. For example, setting may be made so that W=0.8. Note that the value of the smoothing coefficient W is not limited to 0.8. In addition, the previous frame to be subjected to the smoothing process is not limited to the immediately previous frame as indicated by equation (12). For example, the smoothing process may be performed on a plurality of previous frames.

After the smoothing process is completed, the determination correction unit 151 performs reselection (redetermination) of the coding mode by using the corrected analysis parameter $M_p$ (ST155). Note that a method for selecting the coding mode at the time of reselecting the coding mode may be the same as that performed by the coding mode selection unit 142.

In this manner, the analysis parameter $M_p$ is smoothened over the immediately previous frame and the current frame. In addition, as indicated by equation (12), the corrected analysis parameter $M_p$ is more influenced by the analysis parameter $M_p^{[-1]}$ of the previous frame with increasing smoothing coefficient W. That is, in reselection of the coding mode based on the corrected analysis parameter $M_p$, the coding mode used in the previous frame is more frequently selected with increasing smoothing coefficient W.

In this way, according to the present embodiment, frequent switching of the determination result (selection result) of a coding mode between frames can be prevented. As a result, deterioration of the subjective quality of a decoded signal can be prevented.

Third Embodiment

[Configuration of Encoder]

Figure 11:
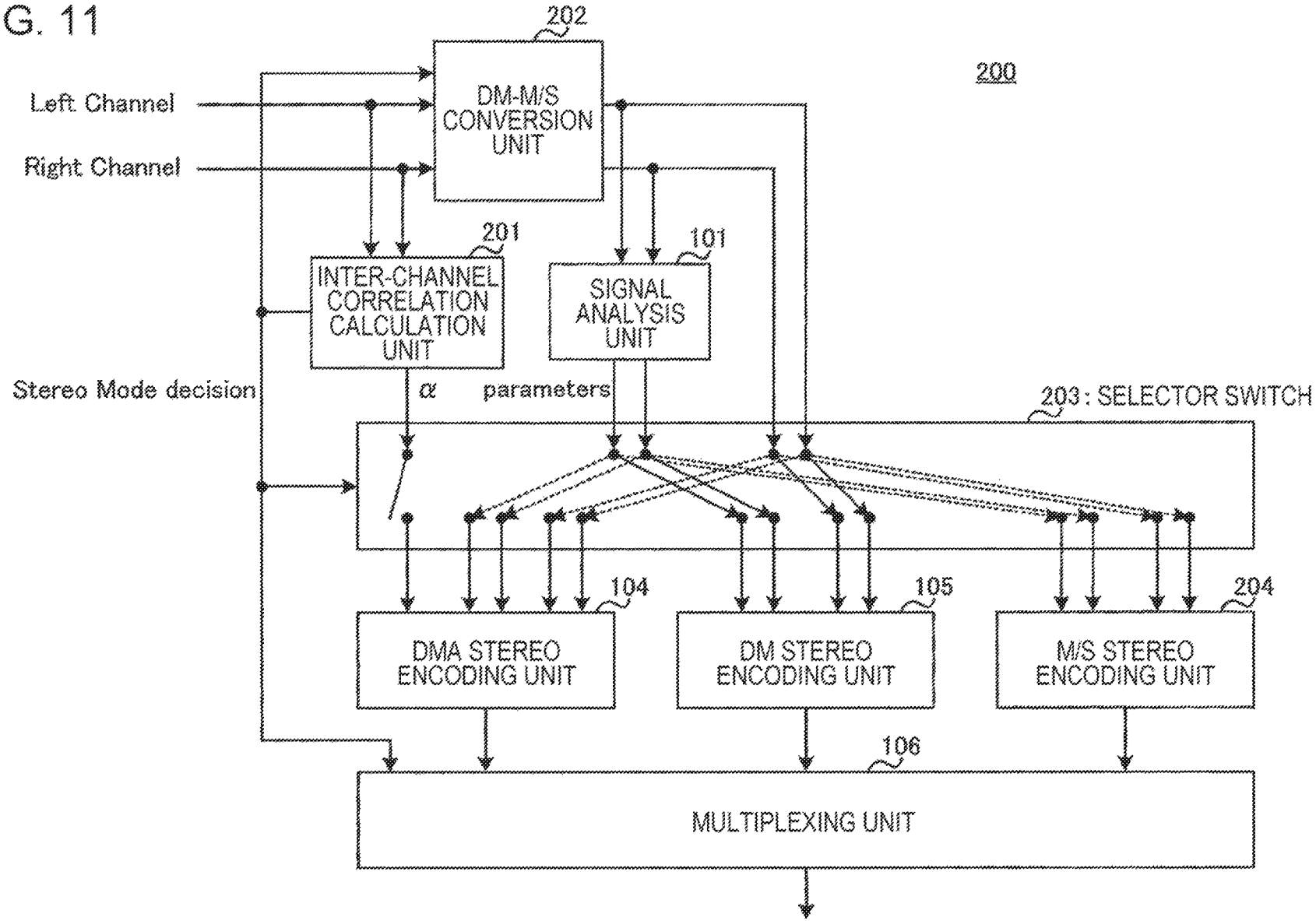
FIG. 11 is a block diagram illustrating a configuration example of an encoder according to a third embodiment.

FIG. 11 is a block diagram illustrating the configuration of an encoder 200 according to the present embodiment.

Note that the same reference numerals are used in FIG. 11 to describe those configurations that are identical to the configurations of the first embodiment (FIG. 5), and the description of the configurations are not repeated. More specifically, as compared with the configurations of the first embodiment (FIG. 5), the encoder 200 illustrated in FIG. 11 further includes a DM-M/S (Mid/Side) conversion unit 202 and an M/S stereo encoding unit 204.

In the encoder 200, an inter-channel correlation calculation unit 201 selects, from among DM stereo encoding, DMA stereo encoding, and added M/S stereo encoding, one of the stereo encoding modes on the basis of the calculated inter-channel correlation (the correlation coefficient $\alpha$). The inter-channel correlation calculation unit 201 outputs a stereo mode decision flag indicating the selection result to the DM-M/S conversion unit 202, a selector switch 203, and the multiplexing unit 106.

For example, as illustrated in FIG. 12, the inter-channel correlation calculation unit 201 may determine that the DM stereo coding mode is to be selected if the correlation coefficient $\alpha$ is 0, may determine that the DMA stereo coding mode is to be selected if the correlation coefficient $\alpha$ is greater than 0 and less than or equal to 0.6, and may determine that the M/S stereo coding mode is to be selected if the correlation coefficient $\alpha$ is greater than 0.6.

That is, if the inter-channel correlation is high ($\alpha$: High; in this example, $0.6<\alpha$), the M/S stereo coding is selected. If the inter-channel correlation is low ($\alpha=0$), the DM stereo coding is selected. If the inter-channel correlation does not fall within any of the above ranges ($\alpha$: Weak; in this example, $0<\alpha\leq 0.6$), the DMA stereo coding is selected.

Note that the ranges of the correlation coefficient $\alpha$ illustrated in FIG. 12 are only illustrative, and the ranges are not limited thereto.

If the stereo mode decision flag input from the inter-channel correlation calculation unit 201 indicates the M/S stereo encoding, the DM-M/S conversion unit 202 converts the L/R channel signal into an M/S signal as described below. Thereafter, the DM-M/S conversion unit 202 outputs the M/S signal to the signal analysis unit 101 and the selector switch 203. If the stereo mode decision flag indicates the DM stereo coding mode or the DMA stereo coding mode, the DM-M/S conversion unit 202 directly outputs the L/R channel signal to the signal analysis unit 101 and the selector switch 203.

If the stereo mode decision flag input from the inter-channel correlation calculation unit 201 indicates the M/S stereo coding mode, the selector switch 203 outputs the input L channel signal and R channel signal and the analysis parameters to the M/S stereo encoding unit 204 in addition to performing the operation of the first embodiment (the selector switch 103).

The M/S stereo encoding unit 204 performs M/S stereo encoding by using the L/R sum signal, the L/R difference signal, and the analysis parameters for each of the signals, which are input from the selector switch 203. When the M/S stereo coding is performed, the L channel signal and R channel signal of the stereo signal are converted into a Mid channel, which is the sum of the two channels, and a Side channel, which is the difference between the two channels in the DM-M/S conversion unit 202. For more information about the M/S stereo coding, the technique described in NPL 2 may be employed, for example.

If the inter-channel correlation is high, the M/S stereo coding is more efficient than the DM stereo coding. More specifically, if the inter-channel correlation is high, the side channel, which is the difference between the two channels, has a value close to zero. Consequently, the amount of encoded information can be reduced. However, if the inter-channel correlation is low, the amount of the encoded information can be reduced by the dual mono encoding, as compared with the M/S stereo encoding. In addition, if the inter-channel correlation is high, it is highly likely that the sound source is a single point sound source (e.g., the case where one person is speaking). In such a case, if L and R channel signals are generated by using a monauralized signal (the Mid channel signal) and the Side channel signal, a more stable stereo soundstage can be obtained.

In addition, as described above, in the M/S stereo coding, since the sum and the difference of the two channels are generated as coding information, decoding related units (not illustrated) decode a to-be-decoded signal on the basis of the coding information (the sum and difference) for each of the frames). That is, the sum of the Mid channel signal, which is the sum signal, and the Side channel signal, which is the difference signal, provides the R channel signal, and the difference between the sum signal (the Mid channel signal) and the difference signal (the Side channel signal) provides the L channel signal. That is, even when the coding modes of the Mid channel signal and the Side channel signal differ from each other, both the signals are reflected in each of the L channel and the R channel and, thus, it is not always necessary to apply the same coding mode. That is, if the M/S stereo coding is used, deterioration of the subjective quality of the decoded signal caused by different coding modes between channels can be prevented.

As described above, the encoder 200 switches between the dual mono encoding (DMA stereo encoding or DM stereo encoding) and the M/S stereo encoding in accordance with the inter-channel correlation (the correlation coefficient $\alpha$). In this manner, the encoder 200 can select an appropriate coding mode and encode a stereo signal in accordance with the inter-channel correlation. As a result, the subjective quality of the decoded signal can be improved. Furthermore, the encoding information can be reduced.

Fourth Embodiment

According to the present embodiment, a method for efficiently obtaining the inter-channel correlation (the correlation coefficient $\alpha$) is described.

The encoder according to the present embodiment has the same basic configuration as that of the encoder 100 according to the first embodiment. For this reason, the encoder is described below with reference to FIG. 5. However, according to the present embodiment, the encoder 100 includes an inter-channel correlation calculation unit 301 illustrated in FIG. 13 instead of the inter-channel correlation calculation unit 102 illustrated in FIG. 5.

The correlation coefficient $\alpha$ given by equation (1) described in the first embodiment is written as the following equation (13):

[Formula 13]

$$\alpha = \frac{\left|\sum_{k=1}^{Frame_{length}} l(k)R^*(k)\right|}{\left(\sqrt{\sum_{k=1}^{Frame_{Length}} l(k)l^*(k)}\right)\left(\sqrt{\sum_{k=1}^{Frame_{length}} R(k)R^*(k)}\right)} = \frac{\text{Cross-Spectrum}}{\left(\sqrt{\text{Left Channel Energy}}\right)\left(\sqrt{\text{Right Channel Energy}}\right)}. \tag{13}$$

That is, as can be seen from equation (13), the correlation coefficient $\alpha$ is separated into a cross-spectrum component (the numerator term "Cross-Spectrum") and L and R channel energy components ("Left Channel Energy" and "Right Channel Energy" in the denominator term).

According to the present embodiment, when the correlation coefficient $\alpha$ is calculated, instead of using all of the frequency spectrum parameters (the spectral coefficients) of the L channel and the R channel, the frequency spectrum parameters of some bands are used. In this manner, the amount of calculation of the cross-correlation coefficient $\alpha$ is reduced.

Figure 13:
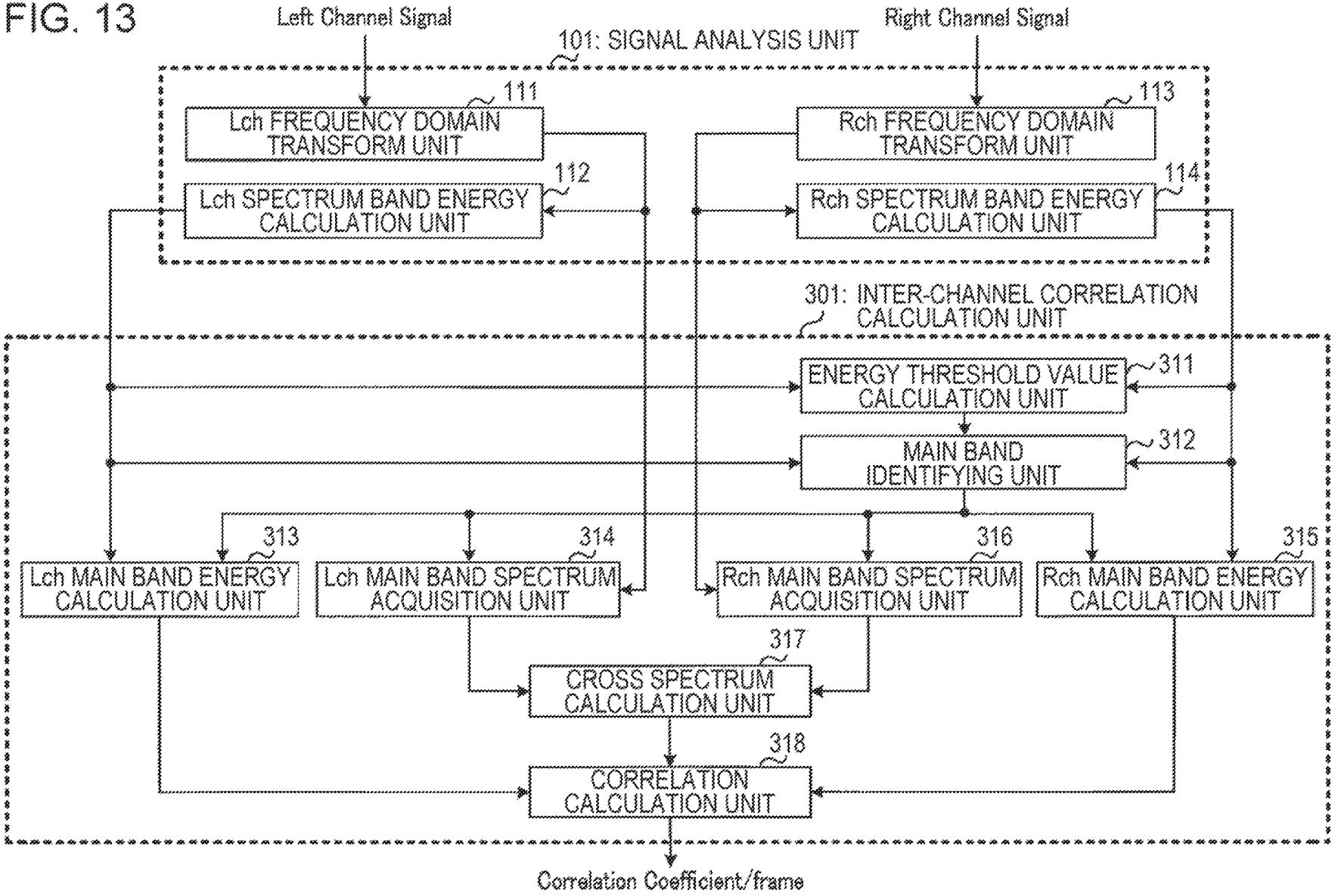
FIG. 13 is a block diagram illustrating a configuration example of a signal analysis unit and an inter-channel correlation calculation unit according to a fourth embodiment.

FIG. 13 is a block diagram illustrating a configuration example of a signal analysis unit 101 and the inter-channel correlation calculation unit 301 according to the present embodiment.

The signal analysis unit 101 employs a configuration including an Lch frequency domain transform unit 111, an Lch spectrum band energy calculation unit 112, an Rch frequency domain transform unit 113, and an Rch spectrum band energy calculation unit 114.

In addition, the inter-channel correlation calculation unit 301 employs a configuration including an energy threshold value calculation unit 311, a main band identifying unit 312, an Lch main band energy calculation unit 313, an Lch main band spectrum acquisition unit 314, an Rch main band energy calculation unit 315, an Rch main band spectrum acquisition unit 316, a cross-spectrum calculation unit 317, and a correlation calculation unit 318.

In the signal analysis unit 101, the Lch frequency domain transform unit 111 performs frequency domain transform on the input L channel signal and outputs Lch frequency spectrum parameters to the Lch spectrum band energy calculation unit 112 and the Lch main band spectrum acquisition unit 314.

The Lch spectrum band energy calculation unit 112 groups the Lch frequency spectrum parameters input from the Lch frequency domain transform unit 111 into a plurality of spectrum bands and calculates the energy of each of the spectrum bands. The Lch spectrum band energy calculation unit 112 outputs the calculated Lch band energy values to the energy threshold value calculation unit 311, the main band identifying unit 312, and the Lch main band energy calculation unit 313.

The Rch frequency domain transform unit 113 performs frequency domain transform on the input R channel signal and outputs the Rch frequency spectrum parameters to the Rch spectrum band energy calculation unit 114 and the Rch main band spectrum acquisition unit 316.

The Rch spectrum band energy calculation unit 114 groups the Rch frequency spectrum parameters input from the Rch frequency domain transform unit 113 into a plurality of spectrum bands and calculates the energy of each of the spectrum bands. The Rch spectrum band energy calculation unit 114 outputs the calculated Rch band energy values to the energy threshold value calculation unit 311, the main band identifying unit 312, and the Rch main band energy calculation unit 315.

Note that it is assumed that the frequency domain transform and spectrum band energy calculation in the signal analysis unit 101 illustrated in FIG. 13 are performed in the codec which is a target of application of the inter-channel correlation calculation unit. In this case, the constituent elements of the signal analysis unit 101 illustrated in FIG. 13 do not have configurations additionally provided for the inter-channel correlation calculation according to the present embodiment. That is, the amount of processing performed by the signal analysis unit 101 does not increase.

Subsequently, in the inter-channel correlation calculation unit 301, the energy threshold value calculation unit 311 calculates an Lch energy threshold value and an Rch energy threshold value by using the Lch band energy values input from the Lch spectrum band energy calculation unit 112 and the Rch band energy values input from the Rch spectrum band energy calculation unit 114, respectively. The energy threshold value calculation unit 311 outputs the calculated Lch and Rch energy threshold values to the main band identifying unit 312.

The main band identifying unit 312 identifies, as the Lch main band, a spectrum band having an energy value that is one of the energy values input from the Lch spectrum band energy calculation unit 112 and that is greater than the Lch energy threshold value input from the energy threshold value calculation unit 311. Similarly, the main band identifying unit 312 identifies, as the Rch main band, a spectrum band having an energy value that is one of the energy values input from the Rch spectrum band energy calculation unit 114 and that is greater than the Rch energy threshold value input from the energy threshold value calculation unit 311. The main band identifying unit 312 outputs, as a "main band", the total sum of the identified Lch main band and R main band, that is, a band corresponding to either the Lch main band or the Rch main band to the Lch main band energy calculation unit 313, the Lch main band spectrum acquisition unit 314, the Rch main band energy calculation unit 315, and the Rch main band spectrum acquisition unit 316.

The Lch main band energy calculation unit 313 calculates the sum of the band energy values that are input from the Lch spectrum band energy calculation unit 112 and that correspond to the main band input from the main band identifying unit 312 and outputs, as the Lch main band energy, the sum to the correlation calculation unit 318.

The Lch main band spectrum acquisition unit 314 extracts the Lch frequency spectrum parameter corresponding to the main band input from the main band identifying unit 312 from the Lch frequency spectrum parameters input from the Lch frequency domain transform unit 111 and outputs, as the Lch main band spectrum, the Lch frequency spectrum parameter to the cross-spectrum calculation unit 317.

The Rch main band energy calculation unit 315 calculates the sum of the band energy values that are input from the Rch spectrum band energy calculation unit 114 and that correspond to the main band input from the main band identifying unit 312 and outputs, as the Rch main band energy, the sum to the correlation calculation unit 318.

The Rch main band spectrum acquisition unit 316 extracts the Rch frequency spectrum parameter corresponding to the main band input from the main band identifying unit 312 from the Rch frequency spectrum parameters input from the Rch frequency domain transform unit 113 and outputs, as the Rch main band spectrum, the Rch frequency spectrum parameter to the cross-spectrum calculation unit 317.

The cross-spectrum calculation unit 317 uses the Lch main band spectrum input from the Lch main band spectrum acquisition unit 314 and the Rch main band spectrum input from the Rch main band spectrum acquisition unit 316 to calculate a cross-spectrum (the numerator term of equation (13)). The cross-spectrum calculation unit 317 outputs the calculated cross-spectrum to the correlation calculation unit 318.

The correlation calculation unit 318 uses the Lch main band energy input from the Lch main band energy calculation unit 313 and the Rch main band energy input from the Rch main band energy calculation unit 315 to calculate the energy values of the L channel and the R channel (the denominator term of equation (13)). Thereafter, the correlation calculation unit 318 uses the calculated energy values (the denominator term of equation (13)) and the cross-spectrum (the numerator term of equation (13)) input from the cross-spectrum calculation unit 317 to calculate the inter-channel correlation (the cross-correlation coefficient $\alpha$ in equation (13)).

Figure 14:
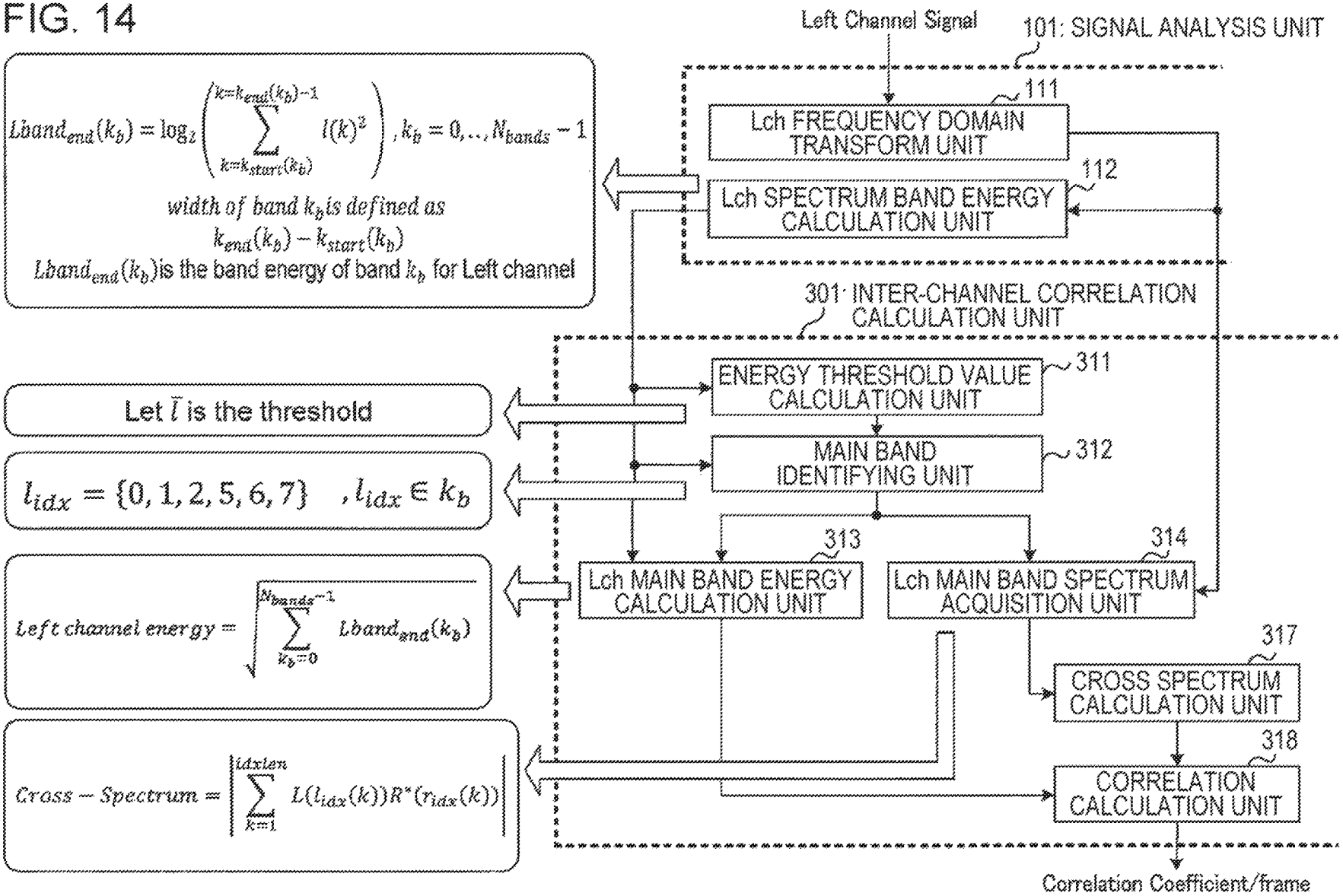
FIG. 14 is a diagram illustrating an operation example performed by the signal analysis unit and the inter-channel correlation calculation unit according to the fourth embodiment.

FIG. 14 illustrates an example of the processing related to the inter-channel correlation calculation process performed on the L channel signal by the signal analysis unit 101 and the inter-channel correlation calculation unit 301.

As illustrated in FIG. 14, the Lch spectrum band energy calculation unit 112 groups Lch frequency spectrum parameters 1 into $N_{bands}$ bands and calculates Lch band energy $Lband_{end}(k_b)$ of band $k_b$ ($k_b$=0 to ($N_{bands}$−1)).

The energy threshold value calculation unit 311 calculates an Lch energy threshold value $l^-$ by using the Lch band energy $Lband_{end}(k_b)$. For example, the energy threshold value calculation unit 311 may define the Lch energy threshold value $l^-$ by using the average value of the Lch band energy $Lband_{end}(k_b)$ or by using the average value and standard deviation of the Lch band energy $Lband_{end}(k_b)$ as described in NPL 1.

For example, when using an average $Avg_{ene}$ of band energy values and a standard deviation $\sigma_{bandene}$, an energy threshold value thr is given by the following equation (14):

[Formula 14]

$$thr=Avg_{ene}+\sigma_{band_{ene}} \quad (14).$$

In addition, the average $Avg_{ene}$ of band energy is given by the following equation (15):

[Formula 15]

$$Ave_{ene} = \frac{1}{N_{bands}} \sum_{k_b=0}^{N_{bands}-1} band_{ene}(k_b). \quad (15)$$

Subsequently, as the main band, the main band identifying unit 312 identifies, among the bands $k_b$ ($k_b$=0 to ($N_{bands}$−1)), a band having an Lch band energy $Lband_{end}(k_b)$ greater than the Lch energy threshold $l^-$. In FIG. 14, as an example, among the bands $k_b$ ($k_b$=0 to ($N_{bands}$−1)), the bands $K_b$=0, 1, 2, 5, 6, and 7 are identified as the main bands $l_{idx}$.

Subsequently, the Lch main band energy calculation unit 313 calculates the sum of the band energy values of the main bands $l_{idx}$ as Lch energy (Left channel energy). Since the Lch band energy $Lband_{end}(k_b)$ has already been calculated by the signal analysis unit 101, the Lch main band energy calculation unit 313 may calculate the total energy of all the bands $k_b$ as Lch energy as illustrated in FIG. 14.

The Lch main band spectrum acquisition unit 314 acquires, among the Lch frequency spectrum parameters l, the Lch frequency spectrum parameter $L(l_{idx})$ included in the Lch main band $l_{idx}$.

The process for Lch has been described above. The process for the R channel signal in the signal analysis unit 101 and the inter-channel correlation calculation unit 301 can be performed in the same manner as in FIG. 14 (not illustrated). In this way, the Rch energy (Right channel energy) and the Rch frequency spectrum parameter $R(r_{idx})$ included in the Rch main band $r_{idx}$ are obtained for the R channel signal.

Thereafter, as illustrated in FIG. 14, the cross-spectrum calculation unit 317 uses the Lch frequency spectrum parameter $L(l_{idx})$ of the Lch main band and the Rch frequency spectrum parameter $R(r_{idx})$ of the Rch main band to calculate a cross-spectrum (Cross-Spectrum).

Note that idxlen represents the number of bands of the main band (in the example of FIG. 14, idxlen=6), and k represents the index of the spectrum band in the main band (in the example of FIG. 14, k=1 to 6 for $k_b$=0, 1, 2, 5, 6 and 7, respectively).

Finally, the correlation calculation unit 318 uses the Lch energy (Left channel energy), the Rch energy (Right channel energy), and the cross-spectrum (Cross-Spectrum) to calculate the inter-channel correlation (α) by using equation (13).

As described above, according to the present embodiment, when calculating the inter-channel correlation, the inter-channel correlation calculation unit 301 calculates the inter-channel correlation by using some of the spectrum bands. In addition, the inter-channel correlation calculation unit 301 uses, as some of the spectrum bands, the main bands having band energy greater than the energy threshold value. Thus, the target of the cross-spectrum calculation can be limited to the frequency spectrum parameters of the main bands. In this manner, according to the present embodiment, the amount of calculation can be reduced while maintaining the accuracy of inter-channel correlation.

Modification 1 of Fourth Embodiment

While the present embodiment has been described with reference to the main band identifying unit 312 that identifies the main band by using the band energy values of both Lch and Rch, a method for identifying the main band is not limited thereto. For example, the main band identifying unit 312 may select a dominant channel out of Lch and Rch and identify the main band of each of Lch and Rch by using the band energy of the selected dominant channel.

Modification 2 of Fourth Embodiment

The fourth embodiment has been described with reference to the inter-channel correlation calculation unit 301 that uses the frequency spectrum parameters included in the spectrum band (the main band) selected by the main band identifying unit 312 to obtain the inter-channel correlation. In contrast, according to the modification, the case is described in which the main spectral components are further selected from the main bands to obtain the inter-channel correlation.

Figure 15:
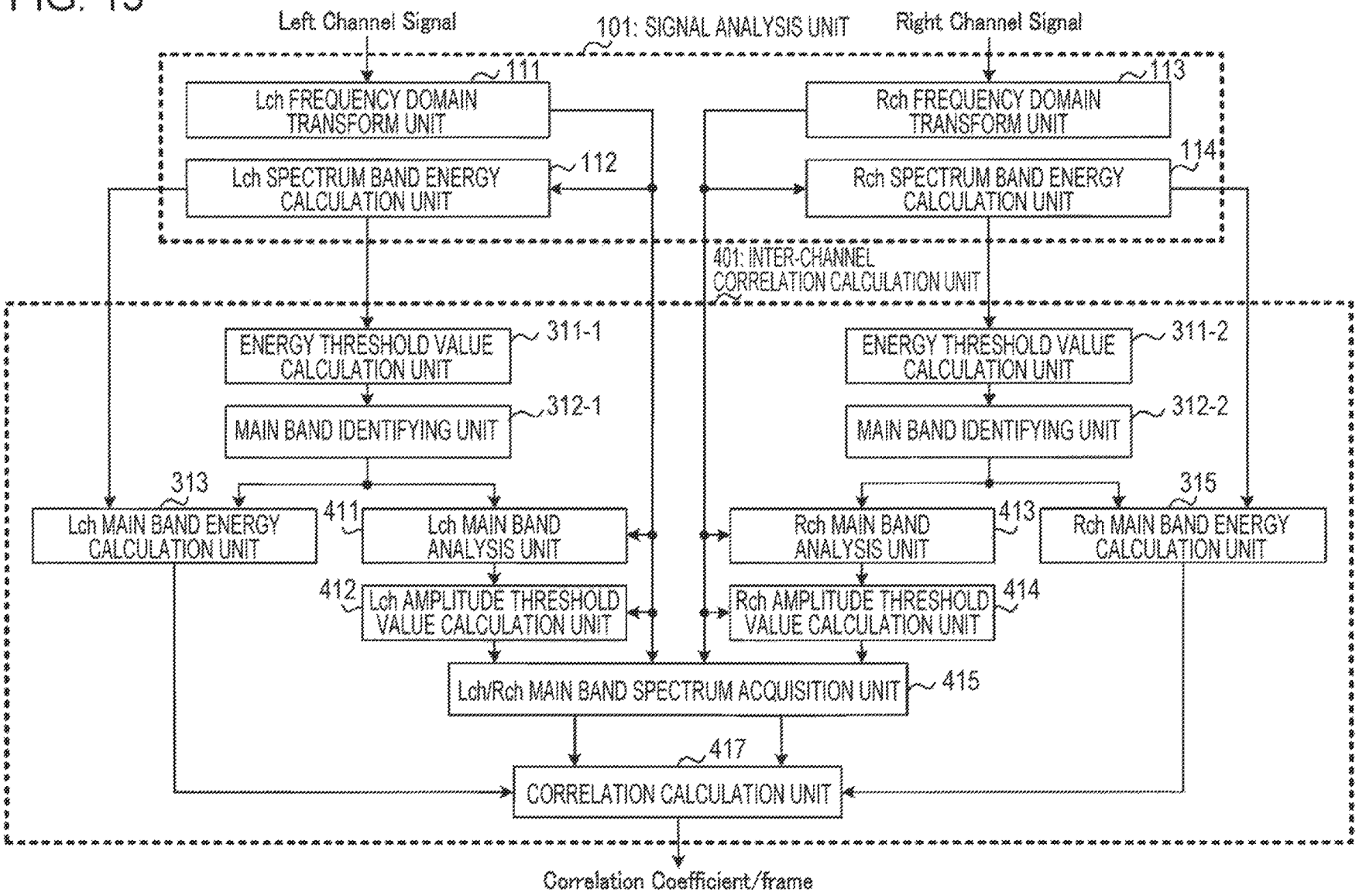
FIG. 15 is a block diagram illustrating a configuration example of a signal analysis unit and an inter-channel correlation calculation unit according to Modification 2 of the fourth embodiment.

FIG. 15 is a block diagram illustrating a configuration example of an inter-channel correlation calculation unit 401 according to Modification 2. Note that the same reference numerals are used in FIG. 15 to describe those configurations that are identical to the configurations in FIG. 13, and the description of the configurations are not repeated. In FIG. 15, an energy threshold value calculation unit 311 and a main band identifying unit 312 are provided for each of Lch and Rch.

In FIG. 15, an Lch main band analysis unit 411 calculates the amplitude (the energy) of the frequency spectrum parameter in the Lch main band input from a main band identifying unit 312-1 among the Lch frequency spectrum parameters input from the Lch frequency domain transform unit 111. The Lch main band analysis unit 411 outputs the amplitude to an Lch amplitude threshold value calculation unit 412.

The Lch amplitude threshold value calculation unit 412 calculates the average amplitude by using the amplitude values of the Lch frequency spectrum parameters in the spectrum band that is identified as the main band and that is input from the Lch main band analysis unit 411. The Lch amplitude threshold value calculation unit 412 outputs, as the Lch amplitude threshold value, the calculated average amplitude value to an Lch/Rch main band spectrum acquisition unit 415.

In addition, an Rch main band analysis unit 413 and an Rch amplitude threshold value calculation unit 414 perform, on the Rch, processing the same as the processing performed by the Lch main band analysis unit 411 and the Lch amplitude threshold value calculation unit 412.

The Lch/Rch main band spectrum acquisition unit 415 selects, from among the Lch frequency spectrum parameters input from the Lch frequency domain transform unit 111, one that is included in the main band and that has an amplitude (energy) greater than the Lch amplitude threshold value input from the Lch amplitude threshold value calculation unit 412. In addition, the Lch/Rch main band spectrum acquisition unit 415 selects, from among the Rch frequency spectrum parameters input from the Rch frequency domain transform unit 113, one that is included in the main band and that has an amplitude (energy) greater than the Rch amplitude threshold input from the Rch amplitude threshold value calculation unit 414. Thereafter, the Lch/Rch main band spectrum acquisition unit 415 selects a frequency component for which a frequency spectrum parameter of at least one of Lch and Rch is selected as a frequency component common to Lch and Rch used for correlation calculation. The Lch/Rch main band spectrum acquisition unit 415 outputs the Lch frequency spectrum parameter and the Rch frequency spectrum parameter of the selected frequency component to a correlation calculation unit 417.

The correlation calculation unit 417 uses the Lch frequency spectrum parameter and Rch frequency spectrum parameter input from Lch/Rch main band spectrum acquisition section 415 to calculate a cross-spectrum (the numerator term of equation (13)). At this time, since the frequency spectrum parameters used for the calculation of the cross-spectrum are limited to particularly high energy components in the Lch main band and the Rch main band, the amount of calculation is reduced, as compared with the case of using all of the frequency spectrum parameters in the Lch main band and the Rch main band.

In addition, like the correlation calculation unit 318, the correlation calculation unit 417 further calculates the denominator term of equation (13) and calculates the correlation coefficient $\alpha$ given by equation (13).

In this way, by further limiting the number of spectrum components included in the asserted band identified by the main band identifying unit 312, the amount of calculation of the cross-spectrum can be further reduced.

Modifications 1 and 2 of the present embodiment have been described above.

It should be noted that the method for identifying the main band described in the present embodiment can be applied to various encoding methods for encoding the spectrum parameter. For example, by adapting to parametric stereo coding using the principle of BCC (Binaural Cue Coding) as described in NPL 3, it is possible to reduce the bit rate and the amount of computation. In parametric stereo coding, encoding is performed for each of the spectrum bands by using, as the side information, the parameters such as the inter-channel level difference (ICLD), inter-channel time difference (ICTD), and inter-channel coherence (ICC). At this time, if the ICLD, ICTD, ICC, and the like are calculated by using only the selected spectrum band or spectrum component by using the selection of the spectrum band and the selection of the spectrum component as described in the present embodiment, the amount of calculation required to calculate the side information can be reduced.

The embodiments of the present disclosure have been described above.

While the above embodiments have been described with reference to the example in which the environmental sound component energy ratio $AE_{ND}$ of the non-dominant channel is calculated by using, for example, equation (5), a method for calculating the environmental sound component energy ratio $AE_{ND}$ of the non-dominant channel is not limited thereto. For example, in equation (5), after identifying the dominant channel and the non-dominant channel, the energy ratio $AE_{ND}$ is calculated. However, the encoder 100 may calculate the energy ratio $AE_{ND}$ without identifying the dominant channel and the non-dominant channel. More specifically, in this case, the encoder 100 calculate each of the environmental sound component energy ratio of the L channel (denoted as, for example, "$AE_L$") and the environmental sound component energy ratio of the R channel (denoted as, for example, "$AE_R$"). Thereafter, the encoder 100 may calculate a weighting coefficient for the analysis parameter of each of the channels by using the higher one of the energy ratio $AE_L$ and the energy ratio $AE_R$.

In addition, according to the above embodiments, when calculating the inter-channel energy difference $\Delta$ (for example, equation (2)), the long-term average of the channel energy may be used, instead of using the instantaneous value of the channel energy (the channel energy for the current frame), to stable the determination result of the dominant channel. For example, the encoder may determine the dominant channel or obtain the weighting coefficient by obtaining the inter-channel energy difference $\Delta$ in accordance with the following equation (16) and using the obtained inter-channel energy difference $\Delta$:

[Formula 16]

$$\Delta = \overline{R}_{11} - \overline{R}_{22} \tag{16}$$

$$\overline{R}_{xx} = \frac{1}{N}\sum_{m=0}^{N-1} R_{xx}^{(frameno_{cur}-m)},\ x = 1,\ 2.$$

In this way, the encoder can make determination of a dominant channel or acquisition of a weighting coefficient with high accuracy.

In equation (16), N represents the number of frames subjected to long-term average calculation of channel energy, and $frameno_{cur}$ represents the current frame index. That is, ($frameno_{cur}$−m) represents a frame m frames before the current frame.

Moreover, the above-described embodiments may be combined and applied. For example, the encoder 200 according to the third embodiment (FIG. 11) may be provided with the DMA stereo encoding unit 150 (FIG. 9) according to the second embodiment instead of the DMA stereo encoding unit 104. Alternatively, the encoder 200 according to the third embodiment (FIG. 11) may be provided with the inter-channel correlation calculation unit 301 (FIG. 13) or the inter-channel correlation calculation unit 401 (FIG. 15) according to the fourth embodiment instead of the inter-channel correlation calculation unit 102.

Moreover, while the above embodiments have been described with reference to the case where ACELP, TCX, HQ MDCT, GSC, or the like is used as an example of the coding mode, the coding mode is not limited thereto.

Note that the present disclosure can be implemented by software, hardware, or software in cooperation with hardware. Each of the functional blocks used in the description of the above embodiments is partially or entirely implemented in the form of an LSI, which is an integrated circuit, and each of the processes described in the above embodiment may be partially or entirely controlled by a single LSI or a combination of LSIs. The LSI may be configured from individual chips or may be configured from a single chip so as to include some or all of the functional blocks. The LSI may have a data input and a data output. The LSI is also referred to as an "IC", a "system LSI", a "super LSI" or an "ultra LSI" in accordance with the level of integration. In addition, the method for circuit integration is not limited to LSI, and the circuit integration may be achieved by dedicated circuitry, a general-purpose processor, or a dedicated processor. Alternatively, an FPGA (Field Programmable Gate Array), which is programmable after fabrication of the LSI, or a reconfigurable processor which allows reconfiguration of connections and settings of circuit cells in LSI may be used. The present disclosure may be implemented as digital processing or analog processing. Moreover, should a circuit integration technology replacing LSI appear as a result of advancements in semiconductor technology or other technologies derived from the technology, the functional blocks could be integrated using such a technology. Another possibility is the application of biotechnology, for example.

According to the present disclosure, an encoder includes a signal analysis circuit that performs signal analysis on a left channel signal and a right channel signal that constitute a stereo signal and generates a parameter used to determine a coding mode for each of a left channel and a right channel, and an encoding circuit that encodes the left channel signal and the right channel signal by using a coding mode common to the left channel signal and the right channel signal. The encoding circuit determines the common coding mode by selecting, out of the left channel and the right channel, the one that has a lower ratio of energy of an environmental sound component to the entire energy of the channel and using the parameter of the selected channel.

According to the encoder of the present disclosure, the encoding circuit identifies a dominant channel and a non-dominant channel for the left channel and the right channel, calculates a first weighting coefficient corresponding to a first parameter used to determine the coding mode of the dominant channel and a second weighting coefficient corresponding to a second parameter used to determine the coding mode of the non-dominant channel on the basis of the ratio for the non-dominant channel, calculates a weighted sum of the first parameter and the second parameter by using the first weighting coefficient and the second weighting coefficient, and selects the common coding mode on the basis of a weighted parameter obtained through the weighted sum calculation.

According to the encoder of the present disclosure, the first weighting coefficient increases, and the second weighting coefficient decreases with increasing ratio for the non-dominant channel.

According to the encoder of the present disclosure, the encoding circuit calculates the ratio by using an inter-channel correlation between the left channel and the right channel and a level difference between the left channel and the right channel.

According to the encoder of the present disclosure, the first weighting coefficient increases, and the second weighting coefficient decreases with decreasing inter-channel correlation.

According to the encoder of the present disclosure, the first weighting coefficient increases, and the second weighting coefficient decreases with increasing level difference with respect to the same inter-channel correlation.

According to the present disclosure, an encoding method includes performing signal analysis on a left channel signal and a right channel signal that constitute a stereo signal and generating a parameter used to determine a coding mode for each of a left channel and a right channel, encoding the left channel signal and the right channel signal by using a coding mode common to the left channel signal and the right channel signal, and determining the common coding mode by selecting, out of the left channel and the right channel, the one that has a lower ratio of energy of an environmental sound component to the entire energy of the channel and using the parameter of the selected channel.

INDUSTRIAL APPLICABILITY

An aspect of the present disclosure is useful for a voice communication system using a multi-mode encoding technique.

REFERENCE SIGNS LIST

100, 200 encoder
101 signal analysis unit
102, 201, 301, 401 inter-channel correlation calculation unit
103, 203 selector switch
104, 150 DMA stereo encoding unit
105 DM stereo encoding unit
106 multiplexing unit
141 adaptive mixing unit
142 coding mode selection unit
143 Lch encoding unit
144 Rch encoding unit
145 bit stream generation unit
151 determination correction unit
202 DM-M/S conversion unit
204 M/S stereo encoding unit
311 energy threshold value calculation unit
312 main band identifying unit
313 Lch main band energy calculation unit
314 Lch main band spectrum acquisition unit
315 Rch main band energy calculation unit
316 Rch main band spectrum acquisition unit
317 cross-spectrum calculation unit
318, 417 correlation calculation unit
411 Lch main band analysis unit
412 Lch amplitude threshold value calculation unit
413 Rch main band analysis unit
414 Rch amplitude threshold value calculation unit
415 Lch/Rch main band spectrum acquisition unit

The invention claimed is:

1. An encoder for encoding audio/speech signals, comprising:

a signal analysis circuit that performs a signal analysis on a left channel signal and a right channel signal that constitute a stereo signal and generates a parameter used to determine a coding mode for each of a left channel and a right channel; and an encoding circuit that encodes the left channel signal and the right channel signal by using a coding mode common to the left channel signal and the right channel signal, wherein the encoding circuit identifies a dominant channel and a non-dominant channel for the left channel and the right channel, calculates a first weighting coefficient corresponding to a first parameter used to determine the coding mode of the dominant channel and a second weighting coefficient corresponding to a second parameter used to determine the coding mode of the non-dominant channel on the basis of a ratio for the non-dominant channel, calculates a weighted sum of the first parameter and the second parameter by using the first weighting coefficient and the second weighting coefficient, and selects the common coding mode on the basis of a weighted parameter obtained through the weighted sum calculation.

2. The encoder according to claim 1, wherein the first weighting coefficient increases and the second weighting coefficient decreases with increasing the ratio for the non-dominant channel.

3. The encoder according to claim 1, wherein the encoding circuit calculates the ratio by using an inter-channel correlation between the left channel and the right channel and a level difference between the left channel and the right channel.

4. The encoder according to claim 3, wherein the first weighting coefficient corresponding to the first parameter used to determine the coding mode of the dominant channel increases and the second weighting coefficient corresponding to the second parameter used to determine the coding mode of the non-dominant channel decreases with decreasing inter-channel correlation.

5. The encoder according to claim 3, wherein the first weighting coefficient corresponding to the first parameter used to determine the coding mode of the dominant channel increases and the second weighting coefficient corresponding to the second parameter used to determine the coding mode of the non-dominant channel decreases with increasing level difference with respect to the same inter-channel correlation.

6. An encoding method for encoding audio/speech signals, the method comprising:

performing a signal analysis on a left channel signal and a right channel signal that constitute a stereo signal and generating a parameter used to determine a coding mode for each of a left channel and a right channel; and encoding the left channel signal and the right channel signal by using a coding mode common to the left channel signal and the right channel signal;

wherein in the encoding, a dominant channel and a non-dominant channel are identified for the left channel and the right channel, a first weighting coefficient corresponding to a first parameter used to determine the coding mode of the dominant channel and a second weighting coefficient corresponding to a second parameter used to determine the coding mode of the non-dominant channel are calculated on the basis of a ratio for the non-dominant channel, a weighted sum of the first parameter and the second parameter is calculated by using the first weighting coefficient and the second weighting coefficient, and the common coding mode is selected on the basis of a weighted parameter obtained through the weighted sum calculation.

7. The encoding method according to claim 6, wherein the first weighting coefficient increases and the second weighting coefficient decreases with increasing the ratio for the non-dominant channel.

8. The encoding method according to claim 6, wherein in the encoding, the ratio is calculated by using an inter-channel correlation between the left channel and the right channel and a level difference between the left channel and the right channel.

9. The encoding method according to claim 8, wherein in the encoding, a dominant channel and a non-dominant channel are identified for the left channel and the right channel, and wherein the first weighting coefficient corresponding to the first parameter used to determine the coding mode of the dominant channel increases and the second weighting coefficient corresponding to the second parameter used to determine the coding mode of the non-dominant channel decreases with decreasing inter-channel correlation.

10. The encoding method according to claim 8, wherein in the encoding, a dominant channel and a non-dominant channel are identified for the left channel and the right channel, and wherein the first weighting coefficient corresponding to the first parameter used to determine the coding mode of the dominant channel increases and the second weighting coefficient corresponding to the second parameter used to determine the coding mode of the non-dominant channel decreases with increasing level difference with respect to the same inter-channel correlation.

* * * * *